US009052621B2

(12) United States Patent
Kusahara et al.

(10) Patent No.: US 9,052,621 B2
(45) Date of Patent: Jun. 9, 2015

(54) IMAGE FORMING APPARATUS

(71) Applicants: Teruki Kusahara, Shizuoka (JP); Tomoyuki Satoh, Kanagawa (JP); Satoshi Ogawa, Nara (JP); Kiwako Hirohara, Miyagi (JP)

(72) Inventors: Teruki Kusahara, Shizuoka (JP); Tomoyuki Satoh, Kanagawa (JP); Satoshi Ogawa, Nara (JP); Kiwako Hirohara, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 51 days.

(21) Appl. No.: 13/752,847

(22) Filed: Jan. 29, 2013

(65) Prior Publication Data

US 2013/0195526 A1 Aug. 1, 2013

(30) Foreign Application Priority Data

Jan. 30, 2012 (JP) ..... 2012-016620

(51) Int. Cl.

| | |
|---|---|
| ***G03G 9/08*** | (2006.01) |
| ***G03G 15/20*** | (2006.01) |
| ***G03G 9/087*** | (2006.01) |

(52) U.S. Cl.

CPC ..... *G03G 9/0821* (2013.01); *G03G 15/2053* (2013.01); *G03G 9/08797* (2013.01); *G03G 2215/2035* (2013.01)

(58) Field of Classification Search

USPC ..... 399/329

See application file for complete search history.

(56) References Cited

U.S. PATENT DOCUMENTS

| | | | | |
|---|---|---|---|---|
| 5,362,593 | A | 11/1994 | Inoue et al. | |
| 7,773,931 | B2 * | 8/2010 | Jung et al. | 399/329 |
| 8,084,178 | B2 * | 12/2011 | Tosaka et al. | 430/108.4 |
| 8,369,760 | B2 * | 2/2013 | Yamamoto et al. | 399/328 |
| 8,383,306 | B2 * | 2/2013 | Pang et al. | 430/108.24 |
| 2004/0184848 | A1 | 9/2004 | Oonishi | |
| 2007/0292175 | A1 | 12/2007 | Shinshi | |
| 2011/0076607 | A1 | 3/2011 | Sugimoto et al. | |
| 2011/0086305 | A1 | 4/2011 | Watanabe et al. | |
| 2011/0129773 | A1 | 6/2011 | Shu et al. | |
| 2011/0151372 | A1 | 6/2011 | Watanabe et al. | |
| 2011/0200928 | A1 | 8/2011 | Watanabe et al. | |
| 2011/0200929 | A1 | 8/2011 | Karato et al. | |
| 2011/0223532 | A1 | 9/2011 | Sugimoto et al. | |

(Continued)

FOREIGN PATENT DOCUMENTS

| | | |
|---|---|---|
| JP | 04-353866 | 12/1992 |
| JP | 08-179563 | 7/1996 |

(Continued)

*Primary Examiner* — Clayton E LaBalle
*Assistant Examiner* — Leon W Rhodes, Jr.
(74) *Attorney, Agent, or Firm* — Oblon, McClelland, Maier & Neustadt, L.L.P.

(57) ABSTRACT

An image forming apparatus including: image bearing member; latent image forming unit; developing unit; transfer unit; fixing unit, wherein toner in the developing unit contains amorphous polymer, crystalline resin and releasing agent, when the toner is measured for G' at 40° C. to 210° C. with rheometer at 1 Hz and 1 deg, G'(100) is ≤20,000 and G'(150) is ≥500 Pa, and straight line drawn by connecting points of the G'(100) and G'(110) on curve of the G' has gradient of ≤0.035, the gradient being "a" expressed by: $a=|\log_{10}G'(100)-\log_{10}G'(110)|/10$, and the fixing unit includes: heating member containing flexible endless belt; heat source fixed within the flexible endless belt; and press member in contact with the belt to form nip portion, and the fixing unit is configured to heat/press the medium passing through the nip portion to fix the image on the medium.

15 Claims, 1 Drawing Sheet

(56) References Cited

U.S. PATENT DOCUMENTS

| | | | |
|---|---|---|---|
| 2011/0262853 | A1 | 10/2011 | Watanabe et al. |
| 2011/0294058 | A1 | 12/2011 | Shiba et al. |
| 2011/0305986 | A1 | 12/2011 | Ogawa et al. |
| 2011/0318053 | A1 | 12/2011 | Yamashita et al. |
| 2012/0021347 | A1 | 1/2012 | Shimota et al. |
| 2012/0052431 | A1 | 3/2012 | Hozumi et al. |
| 2012/0052434 | A1 | 3/2012 | Sugimoto et al. |
| 2012/0064447 | A1 | 3/2012 | Hozumi et al. |
| 2012/0122027 | A1 | 5/2012 | Watanabe et al. |
| 2012/0219896 | A1 | 8/2012 | Asahina et al. |
| 2012/0237869 | A1 | 9/2012 | Chiba et al. |
| 2012/0237870 | A1 | 9/2012 | Watanabe et al. |
| 2012/0264043 | A1 | 10/2012 | Watanabe et al. |

FOREIGN PATENT DOCUMENTS

| | | |
|---|---|---|
| JP | 09-006051 | 1/1997 |
| JP | 2861280 | 12/1998 |
| JP | 2002-131969 | 5/2002 |
| JP | 2003-005557 | 1/2003 |
| JP | 3472371 | 9/2003 |
| JP | 2004-286922 | 10/2004 |
| JP | 2005-195670 | 7/2005 |
| JP | 2006-195106 | 7/2006 |
| JP | 3870447 | 10/2006 |
| JP | 2007-033900 | 2/2007 |
| JP | 2007-233011 | 9/2007 |
| JP | 2007-334205 | 12/2007 |
| JP | 2010-032973 | 2/2010 |

* cited by examiner

IMAGE FORMING APPARATUS

BACKGROUND OF THE INVENTION

1. Field of the Invention

The present invention relates to an image forming apparatus including: a fixing unit configured to form a nip portion between a flexible endless belt and a press member and perform fixing on a recording medium passing through the nip portion.

2. Description of the Related Art

An electrophotographic image forming apparatus forms a latent electrostatic image on the surface of a photoconductor drum serving as an image bearing member and develops the latent electrostatic image on the photoconductor drum with a developer such as an electrostatic image developing toner to form a visible toner image. The electrophotographic image forming apparatus is configured such that the toner image is transferred onto recording paper with a transfer device, and heat and pressure are applied with a fixing device to the recording paper onto which the toner image has been transferred, whereby the toner image on the recording paper is fixed and then the recording paper is discharged outside of the apparatus.

In general, the fixing device has a pair of a heat roller and a press roller facing each other, or a fixing belt, or a combination thereof. The fixing device holds a conveyed recording paper sheet at a nip between the heat roller and the press roller, and applies heat and pressure to the recoding paper sheet passing through the nip to thereby fix the toner image thereon. The fixing device described in Japanese Patent Application Laid-Open (JP-A) No. 2004-286922 is known as such a fixing device that employs a belt.

This belt fixing device described in JP-A No. 2004-286922 has: a nip-forming member inside a fixing belt in the form of an endless sheet to be heated; and a rotatable press roller which is pressed against the nip-forming member via the fixing belt, wherein the contact portion of the fixing belt with the press roller is a fixing nip. Inside the fixing belt is provided a heater lamp for heating the fixing belt which is disposed at a position distant from the fixing nip, and the fixing nip is located above the heater lamp. In addition, a thermistor is provided at a part of the fixing belt. By controlling the heater lamp to be on or off on the basis of the temperature detected by the thermistor, the heat roller and the fixing belt can be adjusted to desired temperatures.

Also, the fixing device described in Japanese Patent (JP-B) No. 2861280 using a heating device has a heating body and a driving member configured to form a nip with the heating body via a slidably moving film and to drive the film. This fixing device applies heat from the heating body via the film to a recording medium carrying an image at the nip to thereby fix the image thereon. In addition, the fixing device described in JP-B No. 3472371 using a heating device is the same as that of JP-B No. 2861280 except that the heating portion for film fixing of the heating device is replaced with a heater and a nip-forming member. Furthermore, as a fixing device having a simple configuration, there has also been proposed one having a fixing belt serving as a heating member, a press roller serving as a press member, a support member, a heat source and a backing member.

In image forming apparatuses based on an electrophotographic or electrostatic recording method containing the fixing devices described in JP-A No. 2004-286922 and JP-B Nos. 2861280 and 3472371, a toner used is deposited at a developing step on an image bearing member (e.g., a photoconductor) having an electrostatic image thereon. Next, the toner image formed on the photoconductor is transferred from the photoconductor onto a transfer medium such as transfer paper at a transfer step, and then fixed on the transfer medium at a fixing step.

JP-A No. 2007-233011 studied improvements in electrostatic image developing toner in order to ensure glossiness of a full-color image while preventing offset which is one problem in a fixing step.

Amid recently increased concerns about environmental protection, energy saving has strongly been required for the above image forming apparatuses. Specifically, they have been required that the power consumption during fixing should be reduced to the greatest extent possible. Meanwhile, it is necessary to obtain good fixing performance even at low fixing temperatures. At present, components of image forming apparatuses have become simple possible because of their reduction in size and weight. Therefore, it is inevitable to further improve toners in their properties in order for image forming apparatuses to be excellent in low-temperature fixing property without a complex configuration and to form high-quality images.

One common method for fixing a toner image on a transfer medium such as transfer paper is a heat-press method. This method is a method where a toner image is fixed by moving an object having the toner image while the toner image is being brought into contact under pressure with a surface of a fixing member which surface is made of a material having releaseability from the toner. Since the surface of the fixing member is in contact with the toner image of the transfer target under pressure, this heat-press method is remarkably excellent in heat conversion efficiency and can perform fixing rapidly. However, in this method, the heat roller of the fixing member is in contact under pressure with the toner image having a heated and molten state and thus when the temperature of the heating roller is too high, the toner causes hot offset which is a problem that the toner melts excessively and adheres to the heat roller. Meanwhile, when the temperature of the heat roller is too law, the toner does not melt sufficiently, leading to gradation in temperature inside the toner layer. As a result, the boundary temperature between the lowermost surface of the toner layer and the surface of the medium does not reach a temperature enough to melt the toner, so that the toner layer is broken, causing cold offset which is a problem that fixing becomes insufficient. Therefore, demand has arisen for development of a toner which is excellent in offset resistance and realizes low-temperature fixing property.

Fixing at low temperatures can be achieved by reducing the molecular weight and/or the glass transition temperature of a binder resin to reduce the softening temperature of the toner; i.e., reduce the lowest fixing temperature of the toner. However, reducing the molecular weight and/or the glass transition temperature of a binder resin makes it easier for the obtained toner to aggregate, so that the toner is degraded in storage stability and causes problems such as blocking. Also, an attempt to improve offset resistance by increasing the elasticity of a binder resin by, for example, increasing its molecular weight tends to increase the lowest fixing temperature of the toner conversely.

In order to solve these problems, there have been proposed attempts to attain both desired low-temperature fixing property and desired offset resistance by focusing on rheology properties of a toner and control viscoelastic behaviors thereof (e.g., JP-A Nos. 04-353866 and 09-006051). The electrophotographic toner of JP-A No. 04-353866 has such rheology properties that a temperature at which its storage modulus starts to decrease falls within 100° C. to 110° C., a storage modulus G'(150) at 150° C. is $1\times10^4$ dyn/cm$^2$ or lower, and the peak temperature of the loss modulus G' is 125° C. or higher. The storage modulus G' and the loss modulus G" are respectively the real part and the imaginary part of a complex modulus, which is one of characteristic functions of viscoelasticity defined in common vibration experiments of objects having viscoelasticity. Specifically, the storage modulus G' indicates the elasticity of the toner and the loss modulus G" indicates the viscosity of the toner. However, the electrophotographic toner of JP-A No. 04-353866 has a high storage modulus G'(150) at 150° C. and a high peak temperature of the loss modulus, and thus is poor in low-temperature fixing property. The electrophotographic image developing toner of JP-A No. 09-006051 contains a binder resin whose storage modulus G' at 120° C. falls within a specific range and complex modulus at 100° C. falls within a specific range. However, even the electrophotographic image developing toner of JP-A No. 09-006051 has too high a storage modulus G'(120) at 120° C. and thus is poor in low-temperature fixing property.

In addition, in order to obtain an excellent image as a color print, a toner good in color mixing property and color developing property is required. In particular, irregularities on the surface of the fixed image reflect light diffusively, so that the glossiness is degraded and the color developing property is also degraded. Thus, it is desirable to form a fixed image having a moderate glossiness and changing in glossiness to a lesser extent even when the fixing temperature is changed.

The toner described in JP-A No. 08-179563 is known as an electrophotgraphic color toner controlled in viscoelastic behaviors to attain stable, high glossiness. This electrophotgraphic color toner of JP-A No. 08-179563 satisfies the expression: $1.2\leq\log(5.0\times10^4)-\log A\leq1.8$, where A is a storage modulus G' [dyn/cm$^2$] at $T_1$+20 [° C.], where $T_1$ is a temperature [° C.] when a storage modulus G' measured under vibration at a frequency of 1,000 Hz is $5\times10^4$ dyn/cm$^2$.

In recent years, the belt fixing devices as described in JP-A No. 2004-286922 have been required to further be shortened in warm-up time (i.e., the time required that the device reaches from a normal temperature to a predetermined temperature (reload temperature) at which printing can be performed after its power source is on) and first print output time (i.e., the time required that a series of printing steps is completed consisting of receiving a printing order, performing a pre-printing step, performing printing operations and discharging paper sheets). As the process speed of image forming apparatuses increases, the number of paper sheets fed per unit time increases to increase a necessary amount of heat. As a result, an amount of heat is insufficient especially at the beginning of continuous printing (i.e., a drop in temperature), which is problematic.

The film fixation of JP-B No. 2861280 is effective as a method for solving the problem in JP-A No. 2004-286922. This method enables a fixing device to be reduced in heat capacity and size as compared with the belt fixing device of JP-A No. 2004-286922. This fixing device locally heats its nip portion only, and the other portions are not heated. As a result, the belt is the coldest at a portion of the nip which a paper sheet enters, which tend to cause fixing failures. Particularly in high-speed devices, more severe fixing failures tend to occur since the rotation speed of the belt is high and thus a more amount of heat is released from the belt at the other portions than the nip.

In the fixing method using a belt (or a film), the belt is moved in a thrust direction while rotated and goes beyond a thrust-preventing member or hits it to buckle, so that the belt may be broken. In some cases, when paper jam at a fixing portion is reversed, force is locally applied to the belt to fold it, so that a fine mark of kink remains. Such a mark may break the belt. A large mark of kink is reflected on the obtained image, causing image failures.

In SURF fixing, a belt has therein a resin holder for retaining a ceramic heater and a metal stay for supporting the belt so as not to bend. This configuration has a problem that the heat capacity inside the belt is so large that heat is absorbed by these members and thus heat conversion efficiency is low (which is an obstacle of energy saving). As seen in SURF fixing, when the belt is rotated distant from a heating body (exothermic body), the belt is cooled due to forced convection, so that heat loss increases to degrade heat conversion efficiency.

The fixing device of JP-B No. 3472371 has a guide roller for stretching a belt from inside of the belt. Such a member in contact with the belt absorbs the heat from the belt to extend the warm-up time and the first print output time. Also, when the nip portion is the parallelism between and the guide roller is lost only slightly, declination occurs between the right-hand portion and left-hand portion in an axial direction of the belt in resistance of rotation of the belt, causing a so-called belt bias.

JP-A No. 2007-233011 studied improvements in toner in order to ensure glossiness of a full-color image while preventing offset which is one problem in a fixing step. In order to obtain a full-color image, it is necessary to make a surface of an image smooth and uniform to ensure glossiness. In addition, it is necessary to prevent expansion of the color-reproducible range due to melting between toner particles and occurrence of the above-described cold offset in a region where the image density is high. Thus, a sufficient amount of heat is applied to the toner for fixing in order to prevent cold offset from occurring. Effective methods for applying a sufficient amount of heat are: increasing the temperature of the heat roller; and reducing the hardness of rubber of the press roller and increasing the diameters of the heat roller and the press roller to expand the nip portion and extend the nip time. Meanwhile, when a sufficient amount of heat is applied to the toner, the toner decreases in elasticity and easier to cause the above-described hot offset. The hot offset can effectively be prevented by coating the heat roller surface with silicone oil which makes it increase in releaseability. This measure is not completely effective and leads to shortening the service life of the apparatus and enlarging it. Thus, it is not a clever measure. Also, silicone oil used for increasing releaseability is desirably reduced to the greatest extent possible since it contaminates the interior of the apparatus during double-side printing, and it is more difficult to write letters or something on the printed matter.

The electrophotographic toner of JP-A No. 04-353866 has a high storage modulus G'(150) at 150° C. and a high peak temperature of the loss modulus, and thus is poor in low-temperature fixing property. Also, even the electrophotographic image developing toner of JP-A No. 09-006051 has too high a storage modulus G'(120) at 120° C. and thus is poor in low-temperature fixing property.

The electrophotographic color toner of JP-A No. 08-179563 has too low a storage modulus G' at $T_1$+20 [° C.] which is A satisfying the above expression, and thus is poor in offset resistance. In general, when the storage modulus G' is lower, the viscosity of the toner becomes predominant. Such a toner tends to move onto the fixing member, and is poor in offset resistance. In contrast, when the storage modulus G' is higher, the toner is restored in shape after fixing by its elasticity, so that irregularities are easier to form on its surface and glossiness is lost. As described above, it is a quite difficult problem to attain both desired offset resistance and desired glossiness.

The present invention has been made in view of the above-described problems, and aims to an image forming apparatus containing in combination a fixing unit and an electrostatic image developing toner, which can shorten the first print output time from the waiting state, which can overcome shortage of heat during high-speed rotation, which can attain excellent fixing property when mounted in mass-productive image forming apparatuses, and which can exhibit both good offset resistance and good glossiness at low fixing temperatures.

SUMMARY OF THE INVENTION

In order to achieve the above object, the present invention provides an image forming apparatus including:

an image bearing member;

a latent image forming unit configured to form a latent electrostatic image on the image bearing member;

a developing unit configured to develop the latent electrostatic image with a toner to form a toner image;

a transfer unit configured to transfer the toner image onto a recording medium;

a fixing unit configured to fix the transferred toner image on the recording medium, wherein the toner contains an amorphous polymer, a crystalline resin and a releasing agent, wherein when the toner is measured for storage modulus G' in a range of 40° C. to 210° C. with a rheometer at a measurement frequency of 1 Hz and a measurement strain of 1 deg, storage modulus G'(100) at 100° C. is 20,000 Pa or less and storage modulus G'(150) at 150° C. is 500 Pa or more, and a straight line drawn by connecting together a point of the storage modulus G'(100) and a point of storage modulus G'(110) at 110° C. on a curve of the storage modulus G' of the toner has a gradient of 0.035 or less where the gradient is "a" expressed by the following equation:

$$a=|\log_{10} G'(100)-\log_{10} G'(110)|/10 \quad \text{(Equation)}$$

wherein the fixing unit includes: a heating member containing a flexible endless belt; a heat source fixed within the flexible endless belt; and a press member in contact with the flexible endless belt to form a nip portion, and the fixing unit is configured to heat and press the recording medium passing through the nip portion to fix the image on the recording medium.

As indicated in the following experiments and evaluations, the present invention has a remarkable effect of providing an image forming apparatus containing in combination a fixing unit and an electrostatic image developing toner, which can shorten the first print output time from the waiting state, which can overcome shortage of heat during high-speed rotation, which can attain excellent fixing property when mounted in mass-productive image forming apparatuses, and which can exhibit both good offset resistance and good glossiness at low fixing temperatures.

Figure 1:
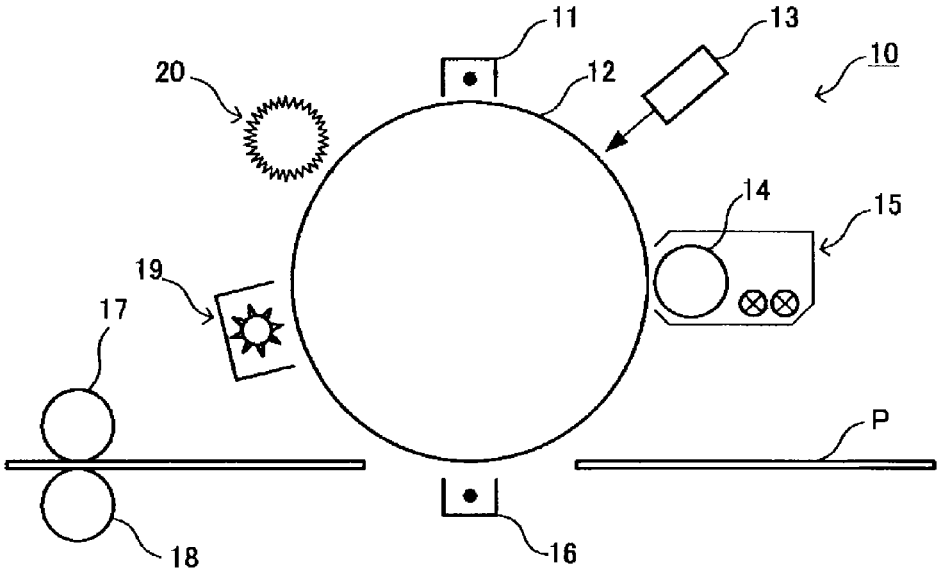
FIG. 1 is a schematic view of one exemplary configuration of an image forming apparatus of the present embodiment.

DETAILED DESCRIPTION OF THE INVENTION (Image Forming Apparatus)

An image forming apparatus of the present invention includes an image bearing member (hereinafter may be referred to as "photoconductor" or "latent electrostatic image bearing member"), a latent image forming unit, a developing unit, a transfer unit and a fixing unit; and, if necessary, further includes other units.

<Image Bearing Member>

The material, shape, structure and size of the image bearing member are not particularly limited and may be appropriately selected from those known in the art. Regarding the material, the image bearing member is, for example, an inorganic photoconductor made of amorphous silicon or selenium and an organic photoconductor made of polysilane or phthalopolymethine. Of these, an amorphous silicon photoconductor is preferred since it has a long service life.

The amorphous silicon photoconductor may be, for example, a photoconductor having a support and a photoconductive layer of a-Si, which is formed on the support heated to 50° C. to 400° C. with a film forming method such as vacuum vapor deposition, sputtering, ion plating, thermal CVD (chemical vapor deposition), photo-CVD or plasma CVD. Of these, plasma CVD is suitably employed, in which gaseous raw materials are decomposed through application of direct current or high-frequency or microwave glow discharge to form an a-Si deposition film on the support.

The shape of the image bearing member is not particularly limited and may be appropriately selected depending on the intended purpose, but is preferably cylindrical. The outer diameter of the cylindrical image bearing member is not particularly limited and may be appropriately selected depending on the intended purpose, but is preferably 3 mm to 100 mm, more preferably 5 mm to 50 mm, particularly preferably 10 mm to 30 mm.

<Latent Image Forming Unit>

The latent image forming unit is not particularly limited and may be appropriately selected depending on the intended purpose so long as it is a unit configured to form a latent electrostatic image on the image bearing member. Examples thereof include a unit containing at least: a charging member configured to charge a surface of the image bearing member; and a light-exposing member configured to imagewise expose the surface of the image bearing member to light.

<<Charging Member and Charging>>

The charging member is not particularly limited and may be appropriately selected depending on the intended purpose. Examples thereof include contact-type chargers known per se having, for example, an electroconductive or semi-electroconductive roller, brush, film and rubber blade; and non-contact-type chargers utilizing corona discharge such as corotron and scorotron.

The above charging can be performed by, for example, applying voltage to the surface of the image bearing member using the charging member.

The charging member may have any shape like a charging roller as well as a magnetic brush or a fur brush. The shape thereof may be suitably selected according to the specification or configuration of the image forming apparatus.

When the magnetic brush is used as the charging member, the magnetic brush is composed of; various ferrite particles as charging means such as Zn—Cu ferrite; a non-magnetic electroconductive sleeve to hold them; and a magnetic roller included in the non-magnetic electroconductive sleeve.

When the fur brush is used as the charging member, the fur brush may be a fur which is treated to be electroconductive with, for example, carbon, copper sulfide, a metal or a metal oxide as well as which is coiled around or mounted to a metal or a metal core treated to be electroconductive.

Although the charging member is not limited to the contact-type charging devices, use of the contact-type charging devices is preferred from the viewpoint of producing an image forming apparatus in which the amount of ozone generated from the charging device is reduced.

<<Light-Exposing Member and Light Exposure>>

The light-exposing member is not particularly limited and may be appropriately selected depending on the intended purpose so long as it can expose the surface of the image bearing member, which surface has been charged with the charging member, to light imagewise according to the intended image. Examples thereof include various light exposing devices such as copying optical systems, rod lens array systems, laser optical systems and liquid crystal shutter optical systems.

The light source used in the light-exposing member is not particularly limited and may be appropriately selected depending on the intended purpose. Examples thereof include usual light-emitting devices such as a fluorescent lamp, a tungsten lamp, a halogen lamp, a mercury lamp, a sodium lamp, a light-emitting diode (LED), a laser diode (LD) or an electroluminescence (EL) lamp.

Also, a filter may be used for applying light having a desired wavelength only. Examples of the filter include various filters such as a sharp-cut filter, a band-pass filter, an infrared cut filter, a dichroic filter, an interference filter or a color conversion filter.

The light exposure can be performed, for example, by imagewise exposing the surface of the image bearing member to light using the light-exposing member.

In the present invention, a back-surface-light-exposing system capable of imagewise exposing from the back side of the image bearing member may be employed.

<Developing Unit>

The developing unit is not particularly limited and may be appropriately selected depending on the intended purpose so long as it is a unit configured to develop the latent electrostatic image with a toner to form a toner image. Examples thereof include a developing unit which contains the toner and can apply the toner to the latent electrostatic image with or without coming into contact with the image bearing member.

The developing device may employ a dry or wet developing process, and may be a single-color or multi-color developing device. Suitable examples thereof include a device containing: a stirrer configured to charge the toner by friction resulting from stirring; and a rotatable magnet roller.

In the developing device, toner particles and preferably carrier particles are stirred and mixed so that the toner particles are charged by friction generated therebetween. The charged toner particles are retained in the chain-like form on the surface of the rotating magnetic roller to form a magnetic brush. The magnetic roller is disposed proximately to the image bearing member and thus, some of the toner particles forming the magnetic brush on the magnet roller are transferred onto the surface of the image bearing member by the action of electrically attractive force. As a result, the latent electrostatic image is developed with the toner particles to form a visual toner image on the surface of the image bearing member.

<<Toner>>

An electrostatic image developing toner used in the present invention will next be described in detail.

The electrostatic image developing toner used in the present invention has rheology properties where it melts instantly by the action of heat energy upon fixing at low temperatures and hardly changes in viscoelasticity after melting. Such rheology properties are controlled by adjusting, for example, the molecular weight of an amorphous polymer to form the crystalline resin and the amount of the crystalline resin.

As seen in the column of "Qualities" in Table 1 presenting evaluation results of Examples 1 to 7 and Comparative Examples 1 to 5 described below, the toners of Examples 1 to 7 do not involve cold offset or hot offset and are evaluated as "A" or "B" in the evaluation of glossiness. In view of these results, the electrostatic image developing toner used in the present invention can be said to have properties that it is rapidly increased in temperature upon heating at low fixing temperatures and dependency of its viscoelasticity to temperature is small.

The properties of the electrostatic image developing toner suitably used in the present invention are defined as follows. That is, when the toner is measured for storage modulus G' in a range of 40° C. to 210° C. with a rheometer at a measurement frequency of 1 Hz and a measurement strain of 1 deg, storage modulus G'(100) at 100° C. is 20,000 Pa or less and storage modulus G'(150) at 150° C. is 500 Pa or more, and a straight line drawn by connecting together a point of the storage modulus G'(100) and a point of storage modulus G'(110) at 110° C. on a curve of the storage modulus G' of the toner has a gradient of 0.035 or less where the gradient is "a" expressed by the following equation:

$$a=|\log_{10} G'(100)-\log_{10} G'(110)|/10.$$

The toner satisfying the above conditions have good offset resistance and good glossiness at low fixing temperatures.

Preferably, the storage modulus G'(100) at 100° C. is 17,000 Pa or less, the storage modulus G'(150) at 150° C. is 1,000 Pa or more and the gradient "a" is 0.032 or less. More preferably, the storage modulus G'(100) at 100° C. is 15,000 Pa or less, the storage modulus G'(150) at 150° C. is 1,500 Pa or more and the gradient "a" is 0.030 or less.

Particularly preferably, the storage modulus G'(100) at 100° C. is 13,000 Pa or less, the storage modulus G'(150) at 150° C. is 1,500 Pa or more and the gradient "a" is 0.025 or less. Particularly preferably, the storage modulus G'(100) at 100° C. is 12,000 Pa or less, the storage modulus G'(150) at 150° C. is 1,500 Pa or more and the gradient "a" is 0.020 or less.

[Measurement Method of Storage Modulus G']

The storage modulus G' in the present invention is measured using, for example, a viscoelasticity measuring device (rheometer) Model RDA-II (product of Rheometrics, Co.). In this measurement, parallel plates each having a diameter of 7.9 mm are used a measurement jig. The measurement sample is prepared as follows: the toner is heated and melted and then molded into a cylindrical sample having a diameter of about 8 mm and a height of 3 mm. The measurement frequency is set to 1 Hz and the measurement temperature is set to 40° C. to 210° C. The measurement strain is set to 0.1% as an initial value and the measurement is performed by an automatic measurement mode. The elongation of the sample is corrected by an automatic measurement mode.

A suitable toner in the present invention will next be described.

The toner contains at least a binder resin and a releasing agent; and, if necessary, further contains other ingredients such as a colorant, a charge controlling agent, resin particles, an external additive and a cleanability improving agent.

—Binder Resin—

The binder resin contains at least an amorphous polymer (i.e., a non-crystalline polymer) and a crystalline resin; and, if necessary, further contains other ingredients such as a reactive modified polyester resin reactive with an active hydrogen group-containing compound, an active hydrogen group-containing compound and an unmodified polyester resin.

—Crystalline Resin—

The crystalline resin is not particularly limited and may be appropriately selected depending on the intended purpose, but is preferably a crystalline polyester resin, particularly preferably one expressed by the following formula, for example:

R1-*m*((-OOC—(—R3-COO-)*n*-)-R2).

In this formula, m is an integer of 1 or greater and is preferably 1 to 3, and n is a degree of polymerization and is an integer of 1 or greater.

Also, R1 and R2 may be identical to or different from each other and each represent a hydrogen atom or a hydrocarbon group. The hydrocarbon group is not particularly limited and may be appropriately selected depending on the intended purpose. Examples thereof include an alkyl group, an alkenyl group and an aryl group. These groups may have a substituent. The alkyl group is preferably one having 1 to 10 carbon atoms, and examples thereof include methyl, ethyl, n-propyl, isopropyl, n-butyl, isobutyl, sec-butyl, n-hexyl, isohexyl, n-heptyl, n-octyl, isooctyl, n-decyl and isodecyl. The alkenyl group is preferably one having 2 to 10 carbon atoms, and examples thereof include vinyl, allyl, propenyl, isopropenyl, butenyl, hexenyl and octenyl. The aryl group is preferably one having 6 to 24 carbon atoms, and examples thereof include phenyl, tollyl, xylyl, cumenyl, styryl, mesityl, cinnamyl, phenethyl and benzhydryl.

In the above formula, R3 represents a divalent hydrocarbon group and is preferably one having 1 to 10 carbon atoms. Examples thereof include an alkylene group represented by —$(CH_2)$p- (where p is 1 to 10). Among them, —$CH_2$—, —$CH_2CH_2$—, —$CH_2CH_2CH_2$— and —$CH_2C(CH_3)H$— are particularly preferred.

The crystallinity and the molecular structure of the crystalline polyester resin may be confirmed, for example, by NMR, differential scanning calorimetry (DSC), X-ray diffraction, GC/MS, LC/MS, and measurement of infrared (IR) absorption spectrum. For example, in its infrared absorption spectrum, a polyester resin that exhibits absorption at wavelengths of 965 $cm^{-1}$±10 $cm^{-1}$ and 990 $cm^{-1}$±10 $cm^{-1}$, which is based on an out-of-plane bending vibration (δCH) of the olefin, is preferred. In this case, it is possible to regard such a polyester resin that exhibits the above absorption as being crystalline.

The molecular weight distribution of the crystalline polyester resin is not particularly limited and may be appropriately selected depending on the intended purpose. The molecular weight distribution thereof is preferably sharp. And, the crystalline polyester resin having a lower molecular weight is more preferred since it is excellent in low-temperature fixing property. In the molecular weight distribution diagram obtained through gel permeation chromatography (GPC) of its ortho-dichlorobenzene soluble matter where the horizontal axis represents log(M) and the vertical axis represents % by mass, it is preferred that a peak be located in a range of 3.5 to 4.0, and that the half width of the peak be 1.5 or less.

The weight average molecular weight (Mw) of the crystalline polyester resin is not particularly limited and may be appropriately selected depending on the intended purpose, but is preferably 1,000 to 30,000, more preferably 1,200 to 20,000. When the weight average molecular weight (Mw) is lower than 1,000, the obtained toner may be degraded in low-temperature fixing property. Whereas when it is higher than 30,000, the obtained toner may be degraded in sharp melt property.

The number average molecular weight (Mn) of the crystalline polyester resin is not particularly limited and may be appropriately selected depending on the intended purpose, but is preferably 500 to 6,000, more preferably 700 to 5,500. When the number average molecular weight (Mn) is lower than 500, the obtained toner may be degraded in low-temperature fixing property. Whereas when it is higher than 6,000, the obtained toner may be degraded in sharp melt property.

The molecular weight distribution (Mw/Mn), which is expressed by a ratio of the weight average molecular weight (Mw) to the number average molecular weight (Mn), is not particularly limited and may be appropriately selected depending on the intended purpose, but is preferably 2 to 8. When the molecular weight distribution (Mw/Mn) is less than 2, production is difficult to perform, potentially leading to cost elevation. Whereas when it is more than 8, the obtained toner may be degraded in sharp melt property.

The melting temperature (Tm) (which may be referred to as "F1/2 temperature") of the crystalline polyester resin is not particularly limited and may be appropriately selected depending on the intended purpose. For example, the melting temperature (Tm) thereof is preferably 50° C. to 150° C., more preferably 60° C. to 130° C., as a DSC endothermic peak temperature in a DSC curve obtained differential scanning calorimetry (DSC). When the melting temperature (Tm) is lower than 50° C., the obtained toner is degraded in heat resistance storage stability and may easily involve blocking at a temperature inside of a developing apparatus. When the melting temperature (Tm) is higher than 150° C., the obtained toner is increased in minimum fixing temperature minimum fixing temperature and cannot exert low-temperature fixing property in some cases.

The acid value of the crystalline polyester resin is not particularly limited and may be appropriately selected depending on the intended purpose, but is preferably 5 mgKOH/g or higher, more preferably 10 mgKOH/g or higher. Meanwhile, from the viewpoint of improving hot offset resistance, the acid value is preferably 45 mgKOH/g or lower. When the acid value is lower than 5 mgKOH/g, satisfactory affinity between paper and the resin cannot be obtained. In addition, the intended low-temperature fixing property cannot be achieved. The acid value of the crystalline polyester resin can be measured as follows, for example. Specifically, the crystalline polyester resin is dissolved in 1,1,1,3,3,3-hexafluoro-2-propanol and the resultant solution is subjected to titration.

The hydroxyl value of the crystalline polyester resin is not particularly limited and may be appropriately selected depending on the intended purpose, but is preferably 0 mgKOH/g to 50 mgKOH/g, more preferably 5 mgKOH/g to 50 mgKOH/g. When the hydroxyl value thereof is higher than 50 mgKOH/g, it may be impossible to attain both intended low-temperature fixing property and good charging property. The hydroxyl value of the crystalline polyester resin can be measured as follows, for example. Specifically, the crystalline polyester resin is dissolved in 1,1,1,3,3,3-hexafluoro-2-propanol and the resultant solution is subjected to titration.

The crystalline polyester resin can be synthesized through, for example, polycondensation reaction between an alcohol component and an acid component.

The alcohol component is not particularly limited and may be appropriately selected depending on the intended purpose. Suitable examples thereof include diol compounds.

The number of carbon atoms of the diol compounds is preferably 2 to 8, more preferably 2 to 6.

Examples of such diol compounds include 1,4-butanediol, ethylene glycol, 1,2-propylene glycol, 1,3-propylene glycol, 1,6-hexanediol, neopentyl glycol, 1,4-butenediol, 1,5-pentanediol and derivatives thereof. These may be used alone or in combination. Among them, 1,4-butanediol and 1,6-hexanediol are particularly preferred.

The amount of the diol compound(s) is preferably 80 mol % or more in the alcohol component, more preferably 85 mol % to 100 mol % in the alcohol component. When the amount of the diol compound(s) in the alcohol component is less than 80 mol %, production efficiency may be degraded.

The acid component is not particularly limited and may be appropriately selected depending on the intended purpose. Examples thereof include carboxylic acids having carbon-carbon double bonds, dicarboxylic acid compounds and polyvalent carboxylic acid compounds, with dicarboxylic acid compounds being preferred.

The number of carbon atoms of the dicarboxylic acid compounds is preferably 2 to 8, more preferably 2 to 6.

Examples of such diol dicarboxylic acid compounds include oxalic acid, malonic acid, maleic acid, fumaric acid, citraconic acid, itaconic acid, glutaconic acid, succinic acid, adipic acid, anhydrides thereof, and C1-C3 alkyl esters of these acids. These may be used alone or in combination. Among them, fumaric acid is particularly preferred.

The amount of the dicarboxylic acid compound(s) is preferably 80 mol % or more in the acid component, more preferably 85 mol % to 100 mol % in the acid component. When the amount of the dicarboxylic acid compound(s) in the acid component is less than 80 mol %, production efficiency may be degraded.

Examples of the polyvalent carboxylic acid compounds include trimellitic acid, pyromellitic acid, anhydrides thereof, and C1-C3 alkyl esters of these acids.

The polycondensation reaction is not particularly limited and may be appropriately selected depending on the intended purpose. The polycondensation reaction can be performed by allowing the alcohol and acid components to react at 120° C. to 230° C. in an inert gas atmosphere using, for example, an esterification catalyst and a polymerization inhibitor. In the polycondensation reaction, all of the monomers may be charged at one time in order to improve the strength of the obtained crystalline polyester resin. Also, in order to reduce the amount of low-molecular-weight components, divalent monomers may be allowed to react and then tri- or higher-valent monomers may be added to the reaction mixture and allowed to react. Furthermore, in order to promote the reaction, the reaction system may be reduced in pressure in the later half period of the polycondensation reaction. In order to control the crystallinity and the softening point of the crystalline polyester resin, the polycondensation reaction may be performed using, as the alcohol component, a trihydric or higher polyhydric alcohol such as glycerin and, as the acid component, a tri- or higher-valent carboxylic acid such as trimellitic anhydride to thereby obtain a non-linear polyester.

Here, one employable production method of the crystalline polyester resin will be described. Specifically, a 5 L four-necked flask equipped with a nitrogen-introducing tube, a dehydration tube, a stirrer and a thermocouple is charged with 1,4-butanediol, fumaric acid, trimellitic anhydride, ethylene glycol, tin octylate and hydroquinone. The resultant mixture is allowed to react at 160° C. for 5 hours. Then, the reaction mixture is allowed to react at 200° C. for 1 hour and further react under pressure of 8.3 kPa for 1 hour, to thereby synthesize a crystalline polyester resin.

(Binder Resin)

The binder resin is not particularly limited and may be appropriately selected from those known as binder resins for use in toners. Examples thereof include polyester resins, polyol resins, polystyrene resins and polystyrene acryl resins. These may be used alone or in combination. Among them, when an adhesive base material in the toner contains a polyester resin as a main ingredient, the binder resin is preferably a polyester resin from the viewpoint of compatibility upon fixing. In addition, since the obtained toner is improved in low-temperature fixing property and in glossiness when used in a full-color image forming apparatus, a polyester resin is preferred.

The glass transition temperature (Tg) of the binder resin is not particularly limited and may be appropriately selected depending on the intended purpose, but is preferably 30° C. to 80° C., more preferably 40° C. to 65° C. When the glass transition temperature (Tg) is lower than 30° C., the obtained toner may be degraded in heat resistance storage stability. Whereas when it is higher than 80° C., the obtained toner may be degraded in low-temperature fixing property.

The weight average molecular weight (Mw) of the binder resin is not particularly limited and may be appropriately selected depending on the intended purpose, but is preferably 2,000 to 90,000, more preferably 2,500 to 30,000. When the weight average molecular weight is less than 2,000, the obtained toner may be degraded in heat resistance storage stability. Whereas when it is more than 90,000, the obtained toner may be degraded in low-temperature fixing property.

In the present invention, the glass transition temperature (Tg) of the binder resin in the toner is generally 50° C. to 70° C., preferably 55° C. to 65° C. When the glass transition temperature is lower than 50° C., the obtained toner is degraded in heat resistance storage stability. Whereas when it is higher than 70° C., the obtained toner is insufficient in low-temperature fixing property. When the toner in the present invention is a dry toner, by using a modified polyester (e.g., a urea-modified polyester resin) in combination, the toner is better in heat resistance storage stability than known polyester-based toners even when the glass transition temperature of the binder resin used is low.

As for the storage modulus of the binder resin, the temperature (TG') at which it is 10,000 dyn/cm$^2$, at a measurement frequency of 20 Hz, is generally 100° C. or higher, preferably 110° C. to 200° C. When the temperature (TG') is lower than 100° C., there is a decrease in hot offset resistance. As for the viscosity of the binder resin, the temperature (Tη) at which it is 1,000 poise, at a measurement frequency of 20 Hz, is generally 180° C. or lower, preferably 90° C. to 160° C. When the temperature (Tη) is higher than 180° C., there is a decrease in low-temperature fixing property. Accordingly, it is preferable in terms of a balance between low-temperature fixing property and hot offset resistance that the TG' is higher than the Tη. In other words, the difference (TG'−Tη) between TG' and Tη is preferably 0° C. or greater. It is more preferably 10° C. or greater, particularly preferably 20° C. or greater. The upper limit of the difference between TG' and Tη is not particularly limited. Also, it is preferable in terms of a balance between heat resistance storage stability and low-temperature fixing property that the difference between Tη and Tg is 0° C. to 100° C. It is more preferably 10° C. to 90° C., particularly preferably 20° C. to 80° C.

<<Modified Polyester Resin Reactive with Active Hydrogen Group-Containing Compound>>

The reactive modified polyester resin reactive with an active hydrogen group-containing compound (RMPE) (hereinafter the polyester resin may be referred to simply as "polyester") encompasses a polyester prepolymer containing a functional group reactive with an active hydrogen such as an isocyanate group. The polyester prepolymer used in the present invention is preferably polyester prepolymer (A) containing an isocyanate group, more preferably a urea-modified polyester resin.

The polyester prepolymer (A) containing an isocyanate group is prepared as follows: an active hydrogen group-containing polyester is produced through polycondensation between a polyol (PO) and a polycarboxylic acid (PC) and then the produced polyester is reacted with a polyisocyanate (PIC). Examples of the active hydrogen group contained in the polyester include a hydroxyl group (an alcoholic hydroxyl group and a phenolic hydroxyl group), an amino group, a carboxyl group, a mercapto group, with an alcoholic hydroxyl group being preferred.

Examples of the polyol (PO) include diols (DIOs) and trihydric or higher polyols (TOs). Preferably, a DIO is used alone or as a mixture with a small amount of a TO. Examples of the DIO include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); and adducts of the above-listed bisphenols with alkylene oxides (e.g., ethylene oxide, propylene oxide and butylene oxide). Among them, preferred are alkylene glycols having 2 to 12 carbon atoms and adducts of bisphenols with alkylene oxides, with the latter being particularly preferred. In addition, these are particularly preferably used in combination. Examples of the TO include polyvalent aliphatic alcohols with 3 to 8 or more hydroxyl groups (e.g., glycerin, trimethylolethane, trimethylolpropane, pentaerythritol and sorbitol); phenols with 3 or more hydroxyl groups (e.g., trisphenol PA, phenol novolak and cresol novolak); and adducts of alkylene oxides with the above-listed phenols having 3 or more hydroxyl groups.

Examples of the polycarboxylic acid (PC) include dicarboxylic acids (DICs) and polycarboxylic acids with 3 or more carboxylic groups (TCs). Preferably, a DIC is used alone or as a mixture with a small amount of a TC. Examples of the DIC include alkylene dicarboxylic acids (e.g., succinic acid, adipic acid and sebacic acid); alkenylene dicarboxylic acids (e.g., maleic acid and fumaric acid); and aromatic dicarboxylic acids (e.g., phthalic acid, isophthalic acid, terephthalic acid and naphthalene dicarboxylic acid). Among them, preferred are alkenylene dicarboxylic acids having 4 to 20 carbon atoms and aromatic dicarboxylic acids having 8 to 20 carbon atoms. Examples of the TC include aromatic polycarboxylic acids having 9 to 20 carbon atoms (e.g., trimellitic acid and pyromellitic acid). Notably, the above PCs may be reacted with POs in the form of anhydrides thereof or lower alkyl esters thereof (e.g., methyl esters, ethyl esters and isopropyl esters).

The ratio of PO to PC is generally 2/1 to 1/1, preferably 1.5/1 to 1/1, more preferably 1.3/1 to 1.02/1, in terms of the equivalent ratio [OH]/[COOH] of hydroxyl group [OH] to carboxylic group [COOH].

Examples of the PIC include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aroma-aliphatic diisocyanates (e.g., $\alpha,\alpha,\alpha',\alpha'$-tetramethylxylylene diisocyanate); and isocyanurates. In addition, there can be used products obtained by blocking the above-listed polyisocyanates with a phenol derivative, oxime or caprolactam. Furthermore, these compounds may be used in combination.

The ratio of PIC to hydroxyl group-containing polyester is generally 5/1 to 1/1, preferably 4/1 to 1.2/1, more preferably 2.5/1 to 1.5/1, in terms of the equivalent ratio [NCO]/[OH] of isocyanate group [NCO] to hydroxyl group [OH]. When the equivalent ratio [NCO]/[OH] is greater than 5, low-temperature fixing property degrades. When the relative [NCO] with respect to [OH] is less than 1, the urea content of the modified polyester decreases and hot offset resistance degrades.

The amount of a polyisocyanate (3) (constitutional component) contained in the polyester prepolymer (PIC) having a polyisocyanate group at its end is generally 0.5% by mass to 40% by mass, preferably 1% by mass to 30% by mass, more preferably 2% by mass to 20% by mass. When the amount of the PIC is less than 0.5% by mass, hot offset resistance degrades. In addition, desired heat resistance during storage and desired low-temperature fixing property are not difficult to attain at the same time. Meanwhile, when the amount is greater than 40% by mass, low-temperature fixing property degrades.

The polyester prepolymer (A) generally has, in one molecule thereof, one or more isocyanate groups, preferably 1.5 groups to 3 groups on average, more preferably 1.8 groups to 2.5 groups on average. When the number of the isocyanate group is less than one per one molecule, the molecular weight of the urea-modified polyester decreases and hot offset resistance degrades.

The polyester prepolymer (A) containing an isocyanate group can be allowed to undergo elongation and/or crosslinking reaction with amines (B) to obtain a urea-modified polyester resin (UMPE). The UMPE has excellent effects as the binder resin.

—Active Hydrogen Group-Containing Compound—

Examples of the amines (B) serving as the active-hydrogen group-containing compound include diamines (B1), tri- or higher-valent amines (B2), amino alcohols (B3), aminomercaptans (B4), amino acids (B5), and amino-blocked products (B6) of the amines (B1) to (B5).

Examples of the diamine (B1) include aromatic diamines (e.g., phenylenediamine, diethyltoluenediamine and 4,4'-diaminodiphenylmethane); alicyclic diamines (e.g., 4,4'-diamino-3,3'-dimethyldicyclohexylmethane, diaminocyclohexane, isophoronediamine); and aliphatic diamines (e.g., ethylenediamine, tetramethylenediamine and hexamethylenediamine).

Examples of the tri- or more-valent amine (B2) include diethylenetriamine and triethylenetetramine.

Examples of the amino alcohol (B3) include ethanolamine and hydroxyethylaniline.

Examples of the aminomercaptan (B4) include aminoethyl mercaptan and aminopropyl mercaptan.

Examples of the amino acid (B5) include aminopropionic acid and aminocaproic acid.

Examples of the amino-blocked product (B6) include ketimine compounds and oxazolidine compounds derived from the amines (B1) to (B5) and ketones (e.g., acetone, methyl ethyl ketone and methyl isobutyl ketone).

Among these amines (B), the diamine (B1) is particularly preferred. Also, particularly preferred is a mixture of the diamine (B1) and a small amount of the tri- or more-valent amine (B2).

If necessary, the molecular weight of the modified polyester such as the urea-modified polyester can be controlled using an elongation terminator. Examples of the elongation terminator include monoamines (e.g., diethyl amine, dibutyl amine, butyl amine and lauryl amine) and blocked products thereof (e.g., ketimine compounds).

The ratio of isocyanate group-containing prepolymer (A) to amine (B) is generally ½ to 2/1, preferably 1.5/1 to 1/1.5, more preferably 1.2/1 to 1/1.2, in terms of the equivalent ratio [NCO]/[NHx] of isocyanate group [NCO] to amino group [NHx]. When the ratio [NCO]/[NHx] is greater than 2 or less than ½, the molecular weight of the formed urea-modified polyester decreases, resulting in degradation of hot offset resistance. The amines (B) act as a crosslinking agent and/or an elongating agent for the modified polyester reactive with the active hydrogen group-containing compound.

In the present invention, the urea-modified polyester may contain not only a urea bond but also a urethane bond. The ratio by mole of urea bond to urethane bond is generally 100/0 to 10/90, preferably 80/20 to 20/80, more preferably 60/40 to 30/70. When the relative [urea bond] with respect to [urethane bond] is less than 10%, hot offset resistance degrades.

The urea-modified polyester used in the present invention is produced with, for example, the one-shot method or the prepolymer method. The weight-average molecular weight of the modified polyester such as the urea-modified polyester is generally 10,000 or more, preferably 20,000 to 10,000,000, still more preferably 30,000 to 1,000,000. When the weight-average molecular weight is less than 10,000, hot offset resistance degrades. The number-average molecular weight of the modified polyester such as the urea-modified polyester is not particularly limited when an unmodified polyester described below is used in combination, and may be a value at which the modified polyester having a weight-average molecular weight falling within the above range can be easily obtained. When the modified polyester such as the urea-modified polyester is used alone, the number average molecular weight thereof is 20,000 or lower, preferably 1,000 to 10,000, more preferably 2,000 to 8,000. When it is greater than 20,000, the obtained toner is degraded in low-temperature fixing property and in glossiness when used in a full-color image forming apparatus The urea-modified polyester can be produced with, for example, the following method. Specifically, a polyol and a polycarboxylic acid are heated to a temperature of 150° C. to 280° C. in the presence of a known esterification catalyst such as tetrabutoxy titanate and dibutyltin oxide. Subsequently, the formed water is removed (if necessary, this water removal is performed under reduced pressure) to prepare a polyester having a hydroxyl group. Thereafter, the thus-prepared polyester is reacted with a polyisocyanate (PIC) at a temperature of 40° C. to 140° C. to prepare a polyester prepolymer (A) having an isocyanate group. Further, the thus-prepared prepolymer (A) is reacted with an amine (B) at a temperature of 0° C. to 140° C. to prepare a urea-modified polyester. If necessary, a solvent may be used in the reactions between the prepolymer (A) and the amine (B) and between the hydroxyl group-containing polyester and the polyisocyanate. Examples of the solvent include those inert with respect to a polyisocyanate (PIC). Specific examples thereof include aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide) and ethers (e.g., tetrahydrofuran). In the case where an unmodified polyester (PE) is used in combination, the PE is produced in a manner similar to that performed in the above production for a hydroxyl group-containing polyester, and then the formed PE is dissolved in and mixed with the solution obtained after completion of the production of the urea-modified polyester.

—Unmodified Polyester Resin—

In the present invention, the modified polyester (MPE) such as the urea-modified polyester may be used alone or in combination with an unmodified polyester resin (PE) serving as one component of the binder resin. Use of the modified polyester in combination with the unmodified polyester (PE) is preferred, since the low-temperature fixing property is improved and the glossiness of the image obtained using a full-color image forming apparatus increases.

Examples of the PE include polycondensates between the polyols and the polycarboxylic acids which are similar to those used for the MPE. Also, preferred polyols and polycarboxylic acids are similar to those listed for the MPE. Also, not only the unmodified polyester but also other modified polyesters than urea-modified polyesters (e.g., urethane-modified polyesters) can be used. Preferably, the MPE and the PE are at least partially mixed with/dissolved in (compatible with) each other from the viewpoints of attaining improved low-temperature fixing property and improved hot offset resistance. Thus, preferably, the polyester components forming the MPE are similar to those forming the PE.

The ratio by mass of MPE and PE is generally 5/95 to 80/20, preferably 5/95 to 30/70, more preferably 5/95 to 25/75, still more preferably 7/93 to 20/80. When the relative MPE amount is less than 5%, the hot offset resistance degrades. In addition, desired heat resistance during storage and desired low-temperature fixing property are not difficult to attain at the same time.

The peak molecular weight of the PE is generally 1,000 to 30,000, preferably 1,500 to 10,000, more preferably 2,000 to 8,000. When the peak molecular weight of the PE is lower than 1,000, the obtained toner is degraded in heat resistance storage stability. Whereas when it is higher than 10,000, the obtained toner is degraded in low-temperature fixing property. The hydroxyl value of the PE is preferably 5 or more, more preferably 10 to 120, particularly preferably 20 to 80. The PE having a hydroxyl value of less than 5 is disadvantageous in terms of providing the obtained toner with both desired heat resistance storage stability and desired low-temperature fixing property. The acid value of the PE is generally 1 to 30, preferably 5 to 20. The PE having an acid value tends to make the obtained toner negatively chargeable.

—Releasing Agent—

The releasing agent may be a known releasing agent, and examples thereof include polyolefin waxes (e.g., polyethylene wax and polypropylene wax), long-chain hydrocarbons (e.g., paraffin wax and SASOLWAX), and carbonyl group-containing waxes, with carbonyl group-containing waxes being preferred. Examples of the carbonyl group-containing waxes include polyalkanoic acid esters (e.g., carnauba wax, montan wax, trimethylolpropane tribehenate, pentaerythritol tetrabehenate, pentaerythritol diacetate dibehenate, and glycerin tribehenate, 1,18-octadecanediol distearate), polyalkanol esters (e.g., tristearyl trimellitate and distearyl maleate), polyalkanoic acid amides (e.g., ethylenediamine dibehenyl amide), polyalkylamides (e.g., trimellitic acid tristearyl amide), and dialkyl ketones (e.g., distearyl ketone), with polyalkanoic acid esters being preferred.

The melting point of the releasing agent is generally 40° C. to 160° C., preferably 50° C. to 120° C., more preferably 60°

C. to 90° C. Releasing agents which are lower than 40° C. in melting point have an adverse effect on heat-resistant storageability, and releasing agents which are higher than 160° C. in melting point are likely to cause cold offset when toner is fixed at a low temperature.

The melt viscosity of each releasing agent is preferably 5 cps to 1,000 cps, more preferably 10 cps to 100 cps, as a measurement obtained at a temperature higher than the melting point by 20° C. Releasing agents which are higher than 1,000 cps in melt viscosity are not much effective in improving low-temperature fixing property and hot offset resistance.

The amount of the releasing agent contained in the toner is preferably 0% by mass to 40% by mass, more preferably 3% by mass to 30% by mass.

—Colorant—

The colorant may be any known dye and pigment, and examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone and mixtures thereof. The amount of the colorant is generally 1% by mass to 15% by mass, preferably 3% by mass to 10% by mass, relative to the amount of the toner.

The colorant may be mixed with a resin to form a masterbatch. Examples of the binder resin which is used for producing a masterbatch or which is kneaded together with a masterbatch include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required to be performed). In this mixing/kneading, a high-shearing disperser (e.g., three-roll mill) is preferably used.

—Charge Controlling Agent—

If necessary, the toner may contain a charge controlling agent. The charge controlling agent may be any known charge controlling agent. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD), quaternary ammonium salt molybdenum complex TP-302 and TP-415 (these products are of Hodogaya Chemical Co., Ltd.), quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Hoechst AG), LRA-901 and boron complex LR-147 (these products are of Japan Carlit Co., Ltd.), copper phthalocyanine, perylene, quinacridone, azo pigments, and polymeric compounds having, as a functional group, a sulfonic acid group, a carboxyl group or a quaternary ammonium salt.

The amount of the charge controlling agent used is not flatly determined and is varied depending on the type of the binder resin used, on an optionally used additive, and on the toner production method used including a dispersion method. The amount of the charge controlling agent used is 0.1 parts by mass to 10 parts by mass, preferably 0.2 parts by mass to 5 parts by mass, per 100 parts by mass of the binder resin. When the amount of the charge controlling agent is more than 10 parts by mass, the formed toner has too high chargeability, resulting in that the charge controlling agent exhibits reduced effects. As a result, the electrostatic force increases between the developing roller and the toner, decreasing the fluidity of the toner and forming an image with reduced color density. The charge controlling agent may be melt-kneaded together with a masterbatch or a resin before dissolution or dispersion. Needless to say, the charge controlling agent may be dissolved in an organic solvent directly or at the time when other toner components are dispersed in an organic solvent. Furthermore, after the formation of the toner particles, the charge controlling agent may be fixed on the surfaces of the toner particles.

—Resin Particles—

The resin particles preferably have a glass transition temperature (Tg) of 50° C. to 70° C. When the glass transition temperature (Tg) thereof is lower than 50° C., the obtained toner is degraded in storage stability, so that blocking may occur during storage and in a developing unit. Whereas when it is higher than 70° C., the resin particles impair adhesiveness to paper, so that the minimum fixing temperature may be increased. The weight average molecular weight of the resin particles is preferably 100,000 or lower, preferably 50,000 or lower. The lower limit of the weight average molecular weight is generally 4,000. When the weight average molecular weight thereof is higher than 100,000, the resin particles impair adhesiveness to paper, so that the minimum fixing temperature may be increased.

The resin particles used may be any resin capable of forming an aqueous dispersion and may be a thermoplastic or thermosetting resin. Examples thereof include vinyl resins, polyurethane resins, epoxy resins, polyester resins, polyamide resins, polyimide resins, silicon-containing resin, phenol resins, melamine resins, urea resins, aniline resins, ionomer resins and polycarbonates. These may be used alone or in combination. Among them, preferred are vinyl resins, polyurethane resins, epoxy resins, polyester resins and mixtures thereof, from the viewpoint of easily obtaining an aqueous dispersion of spherical resin particles.

The vinyl resin is a polymer produced through homopolymerization or copolymerization of vinyl monomers. Examples of the vinyl resin include styrene-(meth)acylate resins, styrene-butadiene copolymers, (meth)acrylic acid-acrylate polymers, styrene-acrylonitrile copolymers, styrene-maleic anhydride copolymers and styrene-(meth)acrylic acid copolymers. The average particle diameter of the resin particles is preferably 5 nm to 200 nm, more preferably 20 nm to 150 nm.

—External Additive—

In order to assist flowability, developability and chargeability of the toner, inorganic particles are preferably used as an external additive.

The primary particle diameter of the inorganic particles is preferably 5 nm to 100 nm, particularly preferably 10 nm to 50 nm.

Also, the specific surface area of the inorganic particles measured by the BET method is preferably 20 $m^2/g$ to 500 $m^2/g$.

The amount of the inorganic particles used is preferably 0.01% by mass to 5% by mass, particularly preferably 0.01% by mass to 2.0% by mass, relative to the amount of the toner. Specific examples of the inorganic particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride.

In addition, polymer particles may be used, and examples thereof include polystyrenes obtained through, for example, soap-free emulsion polymerization, suspension polymerization or dispersion polymerization; methacrylate copolymers and acrylate copolymers; polycondensates such as silicone, benzoguanamine and Nylon; and polymer particles of thermosetting resins.

Such external additives may be subjected to a surface treatment to be increased in hydrophobicity, so that it can be prevented from degradation in flowability and chargeability even under high-humidity conditions. Examples of preferred surface treatment agents used for this surface treatment include silane coupling agents, silylating agents, fluorinated alkyl group-containing silane coupling agents, organic titanate-containing coupling agents, aluminum-containing coupling agents, silicone oil and modified silicone oil.

—Cleanability Improving Agent—

The cleanability improving agent may be added to the toner for removing the developer remaining after transfer on the image bearing member and primary transfer medium. Examples of the cleanability improving agent include metal salts of fatty acids such as stearic acid (e.g., zinc stearate and calcium stearate), polymer particles formed by soap-free emulsion polymerization, such as polymethyl methacrylate particles and polystylene particles. The polymer particles preferably have a relatively narrow particle size distribution. It is preferable that the volume average particle diameter thereof be 0.01 μm to 1 μm.

—Production of Toner—

The above toner can be produced by the following method, but methods employable in the present invention are not limited thereto.

The toner can be formed by reacting dispersion containing the isocyanate group-containing prepolymer (A) with the amine (B) in an aqueous medium. The method for stably forming the dispersion containing the urea-modified polyester and/or the polyester (A) in the aqueous medium is, for example, a method in which toner materials containing the urea-modified polyester and/or the prepolymer (A) are added to the aqueous medium and dispersed by the application of shearing force. The prepolymer (A) and other toner materials (hereinafter may be referred to as "toner raw materials") such as a crystalline polyester, a releasing agent, and optionally-used materials such as a colorant, a colorant masterbatch, a charge controlling agent and an unmodified polyester may be mixed together at the same time when dispersoids are formed in the aqueous medium. Preferably, the toner raw materials are previously mixed together to prepare an oil phase and then the resultant oil phase is dispersed in the aqueous medium. Also, in the present invention, the toner raw materials such as a crystalline resin, a releasing agent, a colorant, a colorant masterbatch and a charge controlling agent are not necessarily added to the aqueous medium before particles are formed. These toner raw materials may be added thereto after particles have been formed. For example, after particles free of a colorant have been formed, a colorant may be added to the obtained particles with a known dying method.

The method for preparing the oil phase is not particularly limited and may be appropriately selected depending on the intended purpose. Examples thereof include (1) a method where the toner raw materials are gradually added to a solvent under stirring so that they are dissolved or dispersed therein, (2) a method where the toner raw materials are dispersed through a wet process in a solvent, if necessary in the presence of a dispersion aid, to thereby obtain a wet master, and (3) a method where the toner raw materials are dissolved in a solvent, if necessary in the presence of a dispersion aid under heating with stirring together with disperoids and then cooled with stirring or shearing so that the dissolved materials are crystallized, to thereby produce microcrystals of the dispersoids. Among them, the method (3) is preferred.

In the method (3), the cooling rate at which the toner raw materials are cooled is not particularly limited and may be appropriately selected depending on the intended purpose, but is preferably 0.1° C./min to 10° C./min, more preferably 0.1° C./min to 8° C./min, particularly preferably 0.1° C./min to 5° C./min. When the cooling rate is slower than 0.1° C./min, production efficiency may be degraded. When it is faster than 10° C./min, production energy may be spent much. The cooling can be performed using, for example, a known cooling device. Notably, in the present invention, the cooled materials may be roughly pulverized using, for example, a hammer mill or a rotoplex.

The cooling can yield particles of the crystalline polyester resin in the toner raw materials. The particle diameter of the crystalline polyester resin particles is not particularly limited and may be appropriately selected depending on the intended purpose. It is preferably 0.2 μm to 2 μm in terms of a volume average particle diameter. When the volume average particle diameter of the crystalline polyester resin particles is less than 0.2 μm, the obtained toner may be degraded in low-temperature fixing property. When it is more than 2 μm, the crystalline polyester resin particles may not be contained in the obtained toner.

The solvent is not particularly limited and may be appropriately selected depending on the intended purpose, but is preferably an organic solvent. The solvent is preferably one which completely dissolves the crystalline polyester resin at high temperatures to form a transparent homogeneous solution and which is insoluble or poorly soluble to the crystalline polyester resin at low temperatures to form an opaque heterogeneous solution. Specifically, when the melting temperature of the crystalline polyester resin is expressed by (Tm), a more preferred organic solvent cannot dissolve the crystalline polyester resin at a temperature (MD lower than (Tm−40) and can dissolve the crystalline polyester resin at a temperature ([° C.]) equal to or higher than (Tm−40). The organic solvent is not particularly limited and may be appropriately selected depending on the intended purpose. Examples thereof include toluene, ethyl acetate, butyl acetate, methyl ethyl ketone, methyl isobutyl ketone and tetrahydrofuran, with toluene, ethyl acetate, methyl ethyl ketone and tetrahydrofuran being preferred. These may be used alone or in combination.

The temperature at which the crystalline polyester resin is partially dissolved is varied with, for example, the type of a solvent used and cannot flatly be determined. When the melting temperature of the crystalline polyester resin is expressed by (Tm), it is preferably a temperature [° C.] between (Tm−40) and (Tm−30), more preferably (Tm−40) to (Tm−35). When the temperature at which the crystalline polyester resin is partially dissolved is a temperature [° C.] lower than (Tm−40), many parts of the crystalline polyester resin may be dissolved at normal temperature. When it is a temperature [° C.] higher than (Tm−30), much energy may be required for production.

The amount of the solvent used is not particularly limited and may be appropriately selected depending on the intended purpose, but is preferably 30 parts by mass to 900 parts by mass, more preferably 40 parts by mass to 400 parts by mass, relative to 100 parts by mass of the toner raw materials. When the amount thereof is less than 30 parts by mass, the resultant dispersion liquid may increase in viscosity. When it is more than 900 parts by mass, the production efficiency may be degraded and the production cost may be elevated.

Here, one example of the method for producing the oil phase will be described. Specifically, a crystalline polyester resin and a polyester resin serving as a binder resin are thoroughly mixed using a blender. Thereafter, the resultant mixture is melt-kneaded using a biaxial extruder having a cooling function, and then cooled at a cooling rate of 0.1° C./min to 10° C./min to prepare a melt-kneaded product. The obtained melt-kneaded product is partially dissolved in ethyl acetate serving as an organic solvent, to thereby prepare a particle dispersion liquid containing crystalline polyester resin particles.

The volume average particle diameter of the crystalline polyester resin particles in the particle dispersion liquid is not particularly limited and may be appropriately selected depending on the intended purpose, but is preferably 0.2 μm to 2 μm. When the volume average particle diameter thereof is less than 0.2 μm, the obtained toner may be degraded in low-temperature fixing property. When it is more than 2 μm, the volume average particle diameter of the crystalline polyester resin particles is so large that the crystalline polyester resin particles may be unsuitable to use for toners.

The crystalline polyester resin particles in the particle dispersion liquid have crystallinity. Thus, the crystalline polyester resin particles allow the toner exhibit good heat resistance storage stability immediately before the crystalline polyester resin particles start melting. The crystalline polyester resin particles drastically decrease in viscosity at a temperature equal to or higher than the temperature at which the crystalline polyester resin particles start melting, providing toners with sharp melt property. Thus, the crystalline polyester resin particles make it possible to yield the toner having both desired heat resistance storage stability and desired low-temperature fixing property. Also, the crystalline polyester resin particles enable the toner to be improved in a fixable range (the difference between the minimum fixing temperature and the hot offset-occurring temperature), yielding the toner having good fixing property. The particle dispersion liquid of the crystalline polyester resin particles may be used in a variety of fields and can particularly suitably be used for the toner in the present invention and the production method thereof.

The aqueous medium may be water alone or a mixture of water and a water-miscible solvent. Examples of the water-miscible solvent include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

The method for dispersing the oil phase in the aqueous medium is not particularly limited. Known dispersers employing, for example, low-speed shearing, high-speed shearing, friction, high-pressure jetting and ultrasonic wave can be employed. In order for dispersoids to have a particle diameter of 2 μm to 20 μm, a high-speed shearing disperser is preferably used. In use of the high-speed shearing disperser, the rotating speed is not particularly limited and is generally 1,000 rpm to 30,000 rpm, preferably 5,000 rpm to 20,000 rpm. Also, the dispersion time is not particularly limited and is generally 0.1 min to 5 min when a batch method is employed. The temperature during dispersion is generally 0° C. to 150° C. (under pressure), preferably 40° C. to 98° C. The temperature during dispersion is preferably higher since the viscosity of the dispersion formed of the urea-modified polyester and/or the prepolymer (A) is low and the dispersion is easy to perform.

The amount of the aqueous medium is generally 50 parts by mass to 2,000 parts by mass, preferably 100 parts by mass to 1,000 parts by mass, relative to 100 parts by mass of the toner materials (composition) containing the urea-modified polyester and the prepolymer (A). When the amount of the aqueous medium is less than 50 parts by mass, the toner materials are poorly dispersed, so that toner particles having an intended particle diameter cannot be obtained. Meanwhile, use of the aqueous medium in an amount of more than 2,000 parts by mass is not economical. If necessary, a dispersing agent may be used. Use of the dispersing agent is preferred from the viewpoints of attaining a sharp particle size distribution and realizing a stable dispersion state.

In the step of synthesizing the urea-modified polyester from the prepolymer (A), the amine (B) may be added to and reacted in the aqueous medium before the toner materials are dispersed therein. Alternatively, the amine (B) may be added to the aqueous medium after the toner materials have been dispersed therein, causing reaction from the interfaces between the formed particles. In this case, the urea-modified polyester is formed preferentially on the surfaces of the toner particles, which can provide concentration gradient from the surface to the core of the particles.

Examples of the dispersing agent for emulsifying and dispersing, in aqueous liquid, the oil phase in which the toner composition has been dispersed include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl) glycine and N-alkyl-N,N-dimethylammonium betaine.

Also, a fluoroalkyl group-containing surfactant can exhibit its dispersing effects even in a small amount. Examples of the fluoroalkyl group-containing anionic surfactants preferably used include fluoroalkyl carboxylic acids having 2 to 10 carbon atoms and metal salts thereof, disodium perfluorooctanesulfonylglutamate, sodium 3-[omega-fluoroalkyl(C6 to C11)oxy)-1-alkyl(C3 or C4) sulfonates, sodium 3-[omega-fluoroalkanoyl(C6 to C8)-N-ethylamino]-1-propanesulfonates, fluoroalkyl(C11 to C20) carboxylic acids and metal salts thereof, perfluoroalkylcarboxylic acids(C7 to C13) and metal salts thereof, perfluoroalkyl(C4 to C12)sulfonate and metal salts thereof, perfluorooctanesulfonic acid diethanol amide, N-propyl-N-(2-hydroxyethyl)perfluorooctanesulfone amide, perfluoroalkyl(C6 to C10)sulfoneamidepropyltrimethylammonium salts, salts of perfluoroalkyl (C6 to C10)-N-ethylsulfonylglycin and monoperfluoroalkyl (C6 to C16) ethylphosphates.

Examples of commercially available products of the above-listed anionic surfactants include SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of Dainippon Ink and Chemicals, Inc.); EFTOP EF-102, 103, 104, 105, 112, 123A, 123B, 306A, 501, 201 and 204 (these products are of Tohchem Products Co., Ltd.); and FUTARGENT F100 and F150 (these products are of NEOS COMPANY LIMITED).

Examples of the fluoroalkyl group-containing cationic surfactant include fluoroalkyl group-containing primary, secondary or tertiary aliphatic compounds, aliphatic quaternary ammonium salts (e.g., perfluoroalkyl(C6 to C10)sulfonamide propyltrimethylammonium salts), benzalkonium salts, benzetonium chloride, pyridinium salts and imidazolinium salts. Examples of commercially available products of the above-listed cationic surfactants include SURFLON S-121 (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of Dainippon Ink and Chemicals, Inc.); EFTOP EF-132 (product of Tohchem Products Co., Ltd.); and FUTARGENT F-300 (product of Neos COMPANY LIMITED).

In addition, tricalcium phosphate, calcium carbonate, titanium oxide, colloidal silica, hydroxyapatite, and other poorly water-soluble inorganic dispersing agents may be used.

Furthermore, a polymeric protective colloid may be used to stabilize dispersed droplets. Examples of the polymeric protective colloid include acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetone acrylamide and methylol compounds of thereof; acid chlorides (e.g., acrylic acid chloride and methacrylic acid chloride); nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose).

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed particles. Also, the calcium phosphate may be removed through enzymatic decomposition.

Alternatively, the dispersing agent used may remain on the surfaces of the toner particles. However, the dispersing agent is preferably removed after completion of the elongation and/or crosslinking reaction through washing in terms of chargeability of the formed toner.

Furthermore, in order to decrease the viscosity of the liquid containing the toner materials, there can be used a solvent in which the urea-modified polyester or the prepolymer (A) can be dissolved. Use of the solvent is preferred from the viewpoint of attaining a sharp particle size distribution. The solvent used is preferably a volatile solvent having a boiling point lower than 100° C., since solvent removal can be easily performed. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These solvents may be used alone or in combination. Among them, aromatic solvents (e.g., toluene and xylene); and methylene chloride, 1,2-dichloroethane, chloroform and halogenated hydrocarbons (e.g., carbon tetrachloride) are preferred. The solvent is generally used in an amount of 0 parts by mass to 300 parts by mass, preferably 0 parts by mass to 100 parts by mass, more preferably 25 parts by mass to 70 parts by mass, per 100 parts by mass of the prepolymer (A). The solvent used is removed under normal or reduced pressure from the reaction mixture obtained after completion of the elongation and/or crosslinking reaction.

When the modified polyester resin reactive with the active hydrogen is reacted with the amine (B) serving as the crosslinking agent and/or the elongating agent, the time required for the elongation and/or crosslinking reaction is determined based on, for example, reactivity depending on a combination of the isocyanate group of the prepolymer (A) and the amine (B), but is generally 10 min to 40 hours, preferably 2 hours to 24 hours. The reaction temperature is generally 0° C. to 150° C., preferably 40° C. to 98° C. If necessary, a known catalyst may be used. Specific examples thereof include dibutyltinlaurate and dioctyltinlaurate.

Examples of the method for removing the organic solvent from the emulsified dispersion liquid include a method in which the entire reaction system is gradually increased in temperature and/or reduced in pressure to completely evaporate the organic solvent contained in the liquid droplets; and a method in which the emulsified dispersion liquid is sprayed in a dry atmosphere to completely remove and evaporate the water-insoluble organic solvent contained in the liquid droplets and the aqueous dispersing agent, whereby toner particles are formed and also the aqueous dispersing agent can be evaporated and removed. The dry atmosphere in which the emulsified dispersion liquid is sprayed generally uses heated gas (e.g., air, nitrogen, carbon dioxide and combustion gas), especially, gas flow heated to a temperature equal to or higher than the boiling point of the solvent used. By performing the treatment even in a short time using, for example, a spray dryer, a belt dryer or a rotary kiln, the resultant product has satisfactory quality. Alternatively, filtration may be performed.

When the emulsified or dispersed particles having a broad particle size distribution are subjected to washing and drying treatments as is, the washed and dried particles may be classified so as to have a desired particle size distribution. Classification is performed by removing very fine particles using, for example, a cyclone, a decanter or a centrifugal separator in the liquid. Needless to say, classification may be performed on powder obtained after drying but is preferably performed in the liquid from the viewpoint of high efficiency. The thus-removed unnecessary particles or coarse particles may be returned to the melt-kneading step, where the unnecessary particles can be used for forming toner particles. In this case, the unnecessary fine or coarse particles may be in a wet state. The dispersing agent used is preferably removed from the obtained dispersion liquid to the greatest extent possible. Preferably, the dispersing agent is removed through the above-described classification.

The resultant dry toner particles may be mixed with other particles such as releasing agent particles, charge controlling agent particles and colorant particles, and also a mechanical impact may be applied to the mixture for immobilization or fusion of other particles on the toner surface, to thereby prevent the other particles from dropping off from the surfaces of the formed composite particles. Specific examples of the method for applying a mixing or mechanical impact include a method in which an impact is applied to a mixture using a high-speed rotating blade, and a method in which an impact is applied by putting mixed particles into a high-speed air flow and accelerating the air speed such that the particles collide against one another or that the particles are crashed into a proper collision plate. Examples of apparatuses used in these methods include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar.

The toner may be used as a one-component developer free of a carrier; i.e., a magnetic toner or a non-magnetic toner. Alternatively, it may be used together with a carrier as a two-component developer.

When used as a two-component developer, the toner may be used as a mixture with a magnetic carrier. Regarding the ratio between the carrier and the toner in the two-component developer, the amount of the toner is preferably 1 part by mass to 10 parts by mass relative to 100 parts by mass of the magnetic carrier. The magnetic carrier may be conventionally known carriers such as iron powder, ferrite powder, magnetite powder and magnetic resin carriers having a particle diameter of about 20 μm to about 200 μm. The carrier may be coated with a coating resin. Examples of the coating resin include amino resins such as urea-formaldehyde resins, melamine resins, benzoguanamine resins, urea resins, polyamide resins and epoxy resins; polyvinyl or polyvinylidene resins such as acryl resins, polymethyl methacrylate resins, polyacrylonitrile resins, polyvinyl acetate resins, polyvinyl alcohol resins and polyvinyl butyral resins; polystyrene resins such as styrene-acryl copolymer resins; halogenated olefin resins such as polyvinyl chloride; polyester resins such as polyethylene terephthalate resins and polybutylene terephthalate resins; polycarbonate resins, polyethylene resins, polyvinyl fluoride resins, polyvinylidene fluoride resins, polytrifluoroethylene resins, polyhexafluoropropylene resins, copolymers of vinylidene fluoride and acryl monomers, a copolymer of vinylidene fluoride and vinyl fluoride, fluoroterpolymers such as terpolymers formed of tetrafluoroethylene, vinylidene fluoride and non-fluoride monomers, and silicone resins. If necessary, electroconductive powder or other materials may be incorporated into the coating resin.

The electroconductive powder used may be, for example, metal powder, carbon black, titanium oxide, tin oxide and zinc oxide. The electroconductive powder preferably has an average particle diameter of 1 μm or smaller. When the average particle diameter exceeds 1 μm, it is difficult for the electroconductive powder to be controlled in electrical resistance.

<Transfer Unit>

The transfer unit is not particularly limited and may be appropriately selected depending on the intended purpose so long as it is a unit configured to transfer the toner image onto a recording medium. In a preferred embodiment, the transfer unit contains a primary transfer unit configured to transfer the toner images onto an intermediate transfer medium to form a composite image and a secondary transfer unit configured to transfer the composite image onto the recording medium.

The transfer step is not particularly limited and may be appropriately selected depending on the intended purpose so long as it is a step of transferring the toner image onto the recording medium. In a preferred embodiment, the toner images are primarily transferred onto an intermediate transfer medium, from which the toner image is secondarily transferred onto the recording medium.

The transfer step can be performed by, for example, charging the toner image on the image bearing member using a transfer charger, and can be performed with the transfer unit.

Here, when the image to be secondarily transferred onto the recording medium is a color image formed of two or more color toners, the transfer unit can be configured such that images of color toners are superposed on top of one another on the intermediate transfer medium using the primary transfer unit to form a composite image on the intermediate transfer medium, and the composite image is secondarily transferred onto the recording medium using the secondary transfer unit.

The intermediate transfer medium is not particularly limited and may be appropriately selected from known transfer media. Suitable examples thereof include a transfer belt.

The transfer unit (the primary transfer unit and the secondary transfer unit) preferably contains at least a transfer device which transfers the toner images formed on the image bearing member onto the recording medium through charging. Examples of the transfer device include corona transfer devices using corona discharge, transfer belts, transfer rollers, press-transfer rollers and adhesive transfer devices.

Notably, the recording medium is typically plane paper, but it is not particularly limited and may be appropriately selected depending on the intended purpose so long as it can receive an unfixed image after developing. PET bases for OHP can also be used as the recording medium.

<Fixing Unit>

The fixing unit is a unit configured to fix the toner image, which has been transferred onto the recording medium, on the recording medium.

The fixing unit contains at least: a heating member containing a flexible endless belt; a heat source fixed within the flexible endless belt; and a press member in contact with the flexible endless belt to form a nip portion. The fixing unit is configured to heat and press the recording medium passing through the nip portion to fix the image on the recording medium.

<<Heating Member>>

The heating member contains at least the flexible endless belt; and, if necessary, contains other members such as a support member and a backing member.

—Endless Belt—

As the endless belt, for example, there is suitably used an endless belt formed by coating a surface of a belt-shaped thin metal (e.g., nickel or stainless steel) with fluorine.

The endless belt is moved in a circumferential direction together with the press roller.

—Support Member—

The support member makes a portion of the endless belt, which portion faces the press member, keep a predetermined shape to form the nip portion.

The material of the support member preferably has a moderate rigidity, and examples thereof include metal materials such as stainless steel.

—Backing Member—

The backing member applies back pressure to the support member so that the support member can resist the pressure applied by the press member.

The material of the backing member preferably has a moderate rigidity, and examples thereof include metal materials such as stainless steel.

<<Heat Source>>

The heat source is not particularly limited and may be appropriately selected depending on the intended purpose, and examples thereof include a halogen lamp.

The heating temperature of the heat source is generally 80° C. to 200° C.

<<Press Member>>

The press member is, for example, a press roller. The press roller may be a solid or hollow member. Use of a hollow member is preferred since its heat capacity is low. Also, the press member may be provided with the heat source such as a halogen lamp.

<<Nip Portion>>

The endless belt is pressed against the press member, so that a region where the endless belt and the press member are in contact with each other is flat, whereby the nip portion is formed.

The endless belt is preferably pressed against the press member by a press unit such as the support member. As a result, the press member is deformed and a predetermined nip width is formed in the nip portion.

Preferably, a portion of the press member which portion forms the nip portion or a portion of the press member which portion is upstream of the nip portion in a direction in which the recording medium moves is locally heated by the heat source. With this configuration, the heat capacity can be reduced, so that the other members are not heated to increase the heat conversion efficiency.

Preferably, a portion of the press member which portion forms the nip portion or a portion of the press member which portion is upstream of the nip portion in a direction in which the recording medium moves is made thinner than other portions. With this configuration, the heat capacity can be reduced, so that the other members are not heated to increase the heat conversion efficiency. In addition, it is possible to rapidly compensate the heat consumed at the nip portion when the recording medium passes therethrough, leading to improvement in fixing property.

In the present invention, a known light fixing device or other devices may be used in combination with the fixing unit depending on the intended purpose.

<Other Units>

Examples of the other units include a cleaning unit, a charge-eliminating unit, a recycling unit and a controlling unit.

<<Cleaning Unit>>

The cleaning unit is not particularly limited and may be appropriately selected depending on the intended purpose so long as it can remove the toner remaining on the image bearing member. Examples thereof include cleaners such as a magnetic blush cleaner, an electrostatic brush cleaner, a magnetic roller cleaner, a blade cleaner, a brush cleaner and a web cleaner.

The cleaning step is not particularly limited and may be appropriately selected depending on the intended purpose so long as it is a step of removing the toner remaining on the image bearing member. The cleaning step can suitably be performed with the cleaning unit.

<<Charge-Eliminating Unit>>

The charge-eliminating unit is not particularly limited and may be appropriately selected depending on the intended purpose so long as it can apply charge-eliminating bias to the image bearing member. Examples thereof include a charge-eliminating lamp.

The charge-eliminating step is not particularly limited and may be appropriately selected depending on the intended purpose so long as it is a step of applying charge-eliminating bias to the image bearing member to thereby eliminate changes thereof. The charge-eliminating step can suitably performed with the charge-eliminating unit.

<<Recycling Unit>>

The recycling unit is not particularly limited and may be appropriately selected depending on the intended purpose so long as it is a unit configured to convey the toner removed in the cleaning step to the developing device for recycling. Examples thereof include a known conveying unit.

The recycling step is not particularly limited and may be appropriately selected depending on the intended purpose so long as it is a step of conveying the toner removed in the cleaning step to the developing unit for recycling. The recycling step can suitably be performed with the recycling unit.

<<Controlling Unit>>

The controlling unit is not particularly limited and may be appropriately selected depending on the intended purpose so long as it can control the operation of each unit. Examples thereof include devices such as a sequencer and a computer.

The controlling step is not particularly limited and may be appropriately selected depending on the intended purpose so long as it is a step of controlling each of the above steps. The controlling step can suitably be performed with the controlling unit.

The image forming apparatus of the present invention will next be described in detail with reference to the drawings.

FIG. 1 is a schematic view of one exemplary configuration of the image forming apparatus of the present embodiment. An image forming apparatus 10 illustrated in FIG. 1 writes image information as a latent electrostatic image by a light-exposing device 13 on a photoconductor drum 12 (e.g., a photoconductor that is photoconductive) which has been charged by a charging device 11, and visualizes the latent electrostatic image formed on the photoconductor drum 12 by a developing roller 14 using a toner stored in a developing device 15. Then, the toner image formed on the photoconductor drum 12 is transferred by a transfer device 16 onto a recording medium P such as printing paper. While the recording medium P, onto which the toner image has been transferred, is being caused to pass between a heat roller 17 and a press roller 18 under heating and pressing, the toner image is fixed on the recording medium P. The image forming apparatus 10 further contains an erasing light source 19 for erasing the latent electrostatic image after the toner image has been transferred and a cleaner 20 for cleaning the toner remaining on the photoconductor drum 12.

When the image forming apparatus of the present invention is for forming a color image, it uses toners of four colors of three primary colors necessary for forming a color image; i.e., yellow, magenta and cyan, plus black, and forms latent electrostatic images on the photoconductor drum 12 correspondingly to the four colors. Through a developing step and a transfer step, each toner is carried on a recording medium or an intermediate transfer medium. These developing and transfer steps are sequentially performed several times and the toner images are superposed on top of one another on the same recording medium or intermediate transfer medium while the toner images are being registered. Without using the intermediate transfer medium, the toner images are fixed at one time on the image recording medium. When the intermediate transfer medium is used, the toner images are superposed on top of one another on the intermediate transfer medium and the superposed image is transferred onto the recording medium, where it is fixed at one time to form an image.

Figure 2:
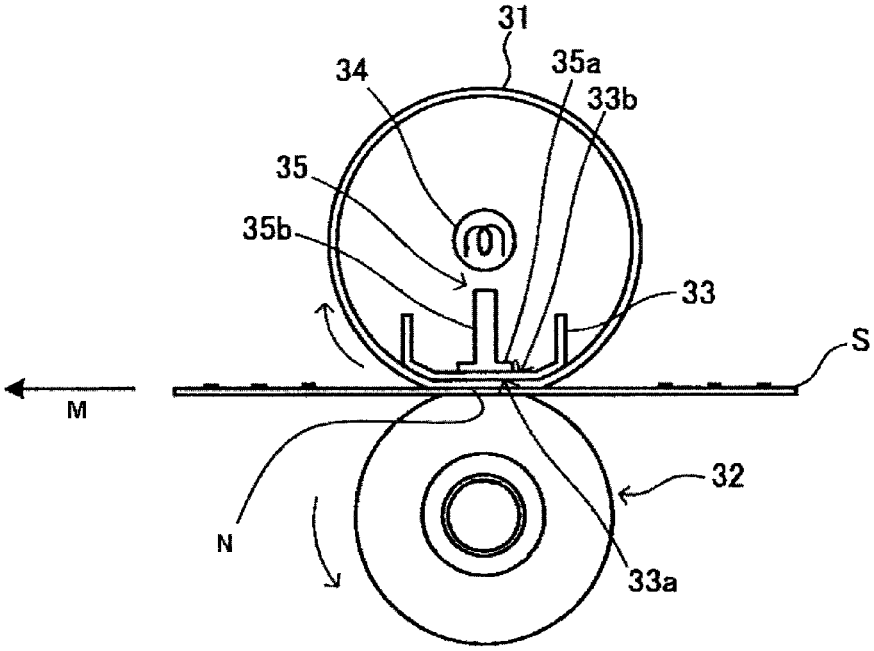
FIG. 2 is a schematic view of one exemplary configuration of a fixing unit mounted to an image forming apparatus of the present embodiment.

As illustrated in FIG. 2, a fixing unit suitably used in the image forming apparatus contains a fixing belt 31 serving as the heating member, a press roller 32 serving as the press member, a support member 33, a heater 34 serving as the heat source, and a backing member 35. The fixing belt 31 comes into contact with the press roller 32 to form a nip portion N. The fixing belt 31 is an endless flexible belt and has moderate rigidity and elasticity. The fixing belt 31 suitably usable is an endless belt formed by coating a surface of a belt-shaped thin metal (e.g., nickel or stainless steel) with fluorine.

The fixing belt 31 is repeatedly moved on a substantially circular track. Recording paper sheets are moved in the same direction as the movement of the fixing belt 31. In other words, the direction in which the fixing belt 31 is moved is the same as the direction M in which the recording medium is moved. The heater 34 serving as the heat source is provided within a loop of the fixing belt 31. The heater 34 is for melting toner on recording paper S to ensure that the toner is attached onto the recording paper. The heater 34 is, for example, a halogen lamp.

The support member 33 is disposed inside the circular fixing belt 31. The support member 33 is formed to have substantially the same width as that of the fixing belt 31 serving as the heating member. The support member 33 is also formed to have a cross-sectional shape which is concave up, and its lower surface 33*a* is a pressing surface. The support member 33 is for making a portion of the flexible fixing belt 31, which portion faces the press roller 32, keep a predetermined shape (linearly in the example illustrated in FIG. 2) to ensure the fixing nip portion N. The support member 33 is made of a material having a moderate rigidity such as a metal material (e.g., stainless steel).

The backing member 35 is provided on the upper surface 33*b* of the support member 33. The backing member 35 is for applying back pressure to the support member 33 so that the support member 33 can resist the pressure applied by the press roller 32. The backing member 35 is made of a material having a high strength such as stainless steel. As illustrated in FIG. 2, the backing member 35 is formed of a plate-shaped member 35*a* facing the support member 33; and a rib-shaped member 35*b* extending from the plate-shaped member 35*a* toward the center of the loop such that the rib-shaped member 35*b* is perpendicular to the plate-shaped member 35*a*. The backing member 35 has a cross-sectional shape like letter "T." The backing member 35 is attached to the frame of a casing of the apparatus via the rib-shaped member 35*b*. Provision of the backing member 35 can make the support member 33 resist the pressure applied by the press roller 32 even when the support member 33 is made small which comes into contact with the fixing belt 31 serving as the heating member. Optimizing the press roller 32 can prevent offset from potentially occurring at the nip region. As a result, heat can be applied to an unfixed toner image on the recording medium S, making it possible to form a high-quality image.

EXAMPLES

The present invention will next be described in more detail by way of Examples where an image was formed on a recording medium using the electrostatic image developing color toners of the present invention. However, the present invention should not be construed as being limited to these Examples. In the following Examples, the unit "part(s)" means "part(s) by mass" and the unit "%" means "% by mass."

Example 1

Synthesis of Organic Particle Emulsion

A reaction container equipped with a stirring rod and a thermometer was charged with 683 parts of water, 11 parts of sodium salt of sulfuric acid ester of ethylene oxide adduct of methacrylic acid (ELEMINOL RS-30, product of Sanyo Chemical Industries Ltd.), 83 parts of styrene, 83 parts of methacrylic acid, 110 parts of butyl acrylate and 1 part of ammonium persulfate. The resultant mixture was stirred at 400 rpm for 15 min to thereby obtain a white emulsion. The white emulsion was heated to a system temperature of 75° C. and was allowed to react for 5 hours. Then, 30 parts by mass of a 1% by mass aqueous ammonium persulfate solution was added to the reaction mixture, followed by aging at 75° C. for 5 hours, to thereby obtain an aqueous dispersion [particle dispersion liquid 1] of a vinyl resin (a copolymer of styrene-methacrylic acid-butyl acrylate-sodium salt of sulfate ester of methacrylic acid-ethylene oxide adduct). The volume average particle diameter of the obtained [particle dispersion liquid 1] was found to be 0.10 μm, when measured using a laser diffraction/scattering particle size distribution analyzer (LA-920, product of Horiba, Ltd.). Part of the [particle dispersion liquid 1] was dried to isolate resin. This resin was found to have a Tg of 57° C. and a weight average molecular weight of 121,000.

<Preparation of Aqueous Phase>

Water (990 parts), 80 parts of the [particle dispersion liquid 1], 40 parts of a 48.5% aqueous solution of sodium dodecyldiphenyl ether disulfonate (ELEMINOL MON-7, product of Sanyo Chemical Industries Ltd.) and 90 parts of ethyl acetate were stirred and mixed together to thereby obtain a milky white liquid, which was used as [aqueous phase 1].

<Synthesis of Low-Molecular-Weight Polyester 1>

A reaction container equipped with a condenser, a stirring and a nitrogen-introducing tube was charged with 781 parts by mass of bisphenol A propylene oxide 3 mole adduct, 218 parts by mass of terephthalic acid, 48 parts by mass of adipic acid, and 2 parts by mass of dibutyltin oxide. The resultant mixture was allowed to react under normal pressure at 230° C. for 13 hours, and further react at a reduced pressure of 10 mmHg to 15 mmHg for 7 hours. Then, 45 parts by mass of trimellitic anhydride was added to the reaction container, and the reaction mixture was allowed to react under normal pressure at 180° C. for 2 hours, to thereby obtain [low-molecular-weight polyester 1]. The obtained [low-molecular-weight polyester 1] was found to have a number average molecular weight of 9,600, a weight average molecular weight of 28,000, a Tg of 43° C. and an acid value of 12.2.

<Synthesis of Crystalline Polyester 1>

A 5 L four-necked flask equipped with a nitrogen-introducing tube, a dehydration tube, a stirrer and a thermocouple was charged with 1,260 g of 1,6-butanediol, 120 g of ethylene glycol, 1,400 g of fumaric acid, 350 g of trimellitic anhydride, 3.5 g of tin octylate and 1.5 g of hydroquinone. The resultant mixture was allowed to react at 160° C. for 5 hours. Then, the reaction mixture was allowed to react at 200° C. for 1 hour and further react at 8.3 kPa for 1 hour, to thereby synthesize [crystalline polyester 1]. The obtained [crystalline polyester 1] was found to have a melting point of 89° C. and a SP value of 9.9.

<Preparation of Masterbatch>

Carbon black (REGAL 400R, product of Cabot Corporation) (40 parts), 60 parts of a binder resin (polyester resin: RS-801, product of Sanyo Chemical Industries, Ltd., acid value: 10, weight average molecular weight Mw: 20,000, Tg: 64° C.) and 30 parts of water were mixed together using HENSCHEL MIXER, to thereby obtain a mixture containing pigment aggregates impregnated with water. The obtained mixture was kneaded for 45 min with a two-roll mill whose roll surface temperature had been adjusted to 130° C. The kneaded product was pulverized with a pulverizer so as to have a size of 1 mm, whereby [masterbatch 1] was obtained.

<Synthesis of Ketimine>

A reaction container equipped with a stirring rod and a thermometer was charged with isophorone diisocyanate (170 parts) and methyl ethyl ketone (75 parts), followed by reaction at 50° C. for 5 hours, to thereby obtain [ketimine compound 1]. The amine value of the obtained [ketimine compound 1] was found to be 418.

<Preparation of Oil Phase>

A container to which a stirring rod and a thermometer had been set was charged with 378 parts of the [low-molecular-weight polyester 1], 110 parts of carnauba wax, 220 parts of the [crystalline polyester 1] and 947 parts by mass of ethyl acetate. The resultant mixture was increased in temperature to 80° C. under stirring and kept at 80° C. for 5 hours and then cooled to 30° C. for 1 hour, whereby [raw material solution 1] was obtained.

The obtained [raw material solution 1] (1,324 parts) was placed in a container and treated with a bead mill (ULTRA VISCOMILL, product of AIMEX CO., Ltd.) under the following conditions: liquid-feeding rate: 1 kg/h; disc circumferential speed: 6 m/sec; the amount of zirconia beads having a particle diameter of 0.5 mm packed: 80% by volume; pass time: 3, whereby [raw material dispersion liquid 1] was produced.

Next, the [masterbatch 1] was added to the [raw material dispersion liquid 1] and the resultant mixture was passed once with the beads mill under the above conditions, whereby [oil phase dispersion liquid 1] was obtained. The solid content concentration of the obtained [oil phase dispersion liquid 1] was found to be 50% (130° C., 30 min).

<Emulsification→Deformation→Desolvation>

A container was charged with 800 parts of the [oil phase dispersion liquid 1] and 6.6 parts of the [ketimine compound 1], and the materials were mixed together using a TK homomixer (product of Tokushu Kika Kogyo Co., Ltd.) at 5,000 rpm for 1 min. Then, 1,200 parts of the [aqueous phase 1] was added to the container and the resultant mixture was mixed with the TK homomixer at 13,000 rpm for 3 min, whereby [emulsified slurry 1] was obtained. The [emulsified slurry 1] was charged into a container to which a stirrer and a thermometer had been set, and then left to stand still at 15° C. for 1 hour. The [emulsified slurry 1] was desolvated at 30° C. for 1 hour to thereby obtain [dispersion slurry 1]. The obtained [dispersion slurry 1] was found to have a volume average particle diameter of 5.59 μm and a number average particle diameter of 5.45 μm (which were measured using MULTISIZER II).

<Washing→Drying>

The obtained [dispersion slurry 1] (100 parts) was filtrated under reduced pressure and then subjected to the following washing and drying treatments.

(1): Ion-exchanged water (100 parts) was added to the filtration cake and the mixture was mixed using a TK homomixer (12,000 rpm, 10 min), followed by filtration.

(2): A 10% aqueous sodium hydroxide solution (100 parts) was added to the filtration cake obtained in (1) and the mixture was mixed using a TK homomixer (12,000 rpm, 30 min) under application of ultrasonic vibration, followed by filtration under reduced pressure. This washing treatment was performed again (twice in total).

(3): 10% hydrochloric acid (100 parts) was added to the filtration cake obtained in (2) and the mixture was mixed using a TK homomixer (12,000 rpm, 10 min), followed by filtration.

(4): Ion-exchanged water (300 parts) was added to the filtration cake obtained in (3) and the mixture was mixed using a TK homomixer (12,000 rpm, 10 min), followed by filtration. This treatment was performed twice in total to thereby obtain [filtration cake 1]. The obtained [filtration cake 1] was dried using an air-circulation dryer at 45° C. for 48 hours and sieved with a mesh having an opening of 75 whereby toner 1 was obtained.

Example 2

[Toner 2] was obtained in the same manner as in Example 1 except that the [low-molecular-weight polyester 1] was changed to [low-molecular-weight polyester 2] having a number average molecular weight of 3,200, a weight average molecular weight of 9,500, a Tg of 47° C. and an acid value of 19.0.

Example 3

[Toner 3] was obtained in the same manner as in Example 1 except that the [low-molecular-weight polyester 1] was changed to [low-molecular-weight polyester 3] having a number average molecular weight of 4,200, a weight average molecular weight of 8,200, a Tg of 52° C. and an acid value of 18.0 and to [crystalline polyester 2] having a melting point of 89° C. and a SP value of 9.5.

Example 4

[Toner 4] was obtained in the same manner as in Example 1 except that: the [low-molecular-weight polyester 1] was changed to [low-molecular-weight polyester 4] having a number average molecular weight of 2,600, a weight average molecular weight of 6,400, a Tg of 48° C. and an acid value of 20.2; "Synthesis of prepolymer" was performed by the following method after the "Preparation of masterbatch"; the "Emulsification→deformation→desolvation" was changed to the following process; and the following [dispersion slurry 2] was used in the "Washing→drying."

<Synthesis of Prepolymer>

A reaction container equipped with a condenser, a stirrer and a nitrogen-introducing tube was charged with 682 parts by mass of bisphenol A ethylene oxide 2 mole adduct, 81 parts by mass of bisphenol A propylene oxide 2 mole adduct, 283 parts by mass of terephthalic acid, 22 parts by mass of trimellitic anhydride and 2 parts by mass of dibutyltin oxide. The resultant mixture was allowed to react under normal pressure for 8 hours at 230° C. and then further react at a reduced pressure of 10 mmHg to 15 mmHg for 5 hours, to thereby obtain [intermediate polyester 1]. The obtained [intermediate polyester 1] was found to have a number average molecular weight of 2,100, a weight average molecular weight of 9,500, a Tg of 55° C., an acid value of 0.5 and a hydroxyl group value of 49. Next, a reaction container equipped with a condenser, a stirrer and a nitrogen-introducing tube was charged with 411 parts of the [intermediate polyester 1], 89 parts of isophoron diisocyanate and 500 parts of ethyl acetate. The resultant mixture was allowed to react at 100° C. for 5 hours, to thereby obtain [prepolymer 1]. The free isocyanate content of the [prepolymer 1] was found to be 1.53%.

<Emulsification→Deformation→Desolvation>

A container was charged with 648 parts of the [oil phase dispersion liquid 1], 154 parts of the [prepolymer 1] and 6.6 parts of the [ketimine compound 1], and the materials were mixed together using a TK homomixer (product of Tokushu Kika Kogyo Co., Ltd.) at 5,000 rpm for 1 min. Then, 1,200 parts of the [aqueous phase 1] was added to the container and the resultant mixture was mixed with the TK homomixer at 13,000 rpm for 3 min, whereby [emulsified slurry 2] was obtained. The [emulsified slurry 2] was charged into a container to which a stirrer and a thermometer had been set, and then left to stand still at 15° C. for 1 hour. The [emulsified slurry 1] was desolvated at 30° C. for 1 hour to thereby obtain [dispersion slurry 2].

Example 5

[Toner 5] was obtained in the same manner as in Example 4 except that the amount of the [prepolymer 1] used was changed to 264 parts.

Example 6

[Toner 6] was obtained in the same manner as in Example 4 except that the [low-molecular-weight polyester 4] was changed to [low-molecular-weight polyester 6] having a number average molecular weight of 3,200, a weight average molecular weight of 7,200, a Tg of 52° C. and an acid value of 18.0.

Example 7

[Toner 7] was obtained in the same manner as in Example 4 except that the [low-molecular-weight polyester 4] was changed to [low-molecular-weight polyester 5] having a number average molecular weight of 1,800, a weight average molecular weight of 480, a Tg of 44° C. and an acid value of 20.2.

Comparative Example 1

[Toner 8] was obtained in the same manner as in Example 4 except that the [low-molecular-weight polyester 4] was changed to [low-molecular-weight polyester 7] having a number average molecular weight of 14,000, a weight average molecular weight of 24,500, a Tg of 50° C. and an acid value of 13.0.

Comparative Example 2

[Toner 9] was obtained in the same manner as in Example 4 except that the [low-molecular-weight polyester 4] was changed to [low-molecular-weight polyester 8] having a number average molecular weight of 2,800, a weight average molecular weight of 8,100, a Tg of 52° C., an acid value of 16.0, a T1 of 62.8° C., a T2 of 75.1° C. and a resin softening modulus of 0.374 and to [crystalline polyester 3] having a melting point of 87° C. and a SP value of 9.4.

Comparative Example 3

[Toner 10] was obtained in the same manner as in Example 4 except that the [prepolymer 1] was not used.

Comparative Example 4

[Toner 11] was obtained in the same manner as in Example 4 the amount of the [prepolymer 1] used was changed to 526 parts.

Comparative Example 5

[Toner 12] was obtained in the same manner as in Example 1 the amount of the [crystalline polyester 1] was changed to 440 parts.

Each (100 parts) of the toners obtained in the above-described manner was mixed with 0.7 parts of hydrophobic silica and 0.3 parts of hydrophobic titanium oxide serving as external additives.

<<Evaluation Items>>

Each (5%) of the toners which had been treated with the external additives was mixed with 95% of a copper-zinc ferrite carrier coated with a silicone resin (average particle diameter: 40 μm) to thereby prepare developers. Each of the prepared developers was incorporated into a modified apparatus of IMAGIO NEO450 (product of Ricoh Company, Ltd.) capable of printing out 45 sheets of A4 paper per minute and containing the above-described fixing unit. The modified apparatus was used to perform continuous printing and the toner was evaluated in the following manner. The evaluation results are presented in Table 1.

—Measurement of Storage Modulus G'—

The storage modulus G' was measured using a viscoelasticity measuring device (rheometer) Model RDA-II (product of Rheometrics, Co.)

under the following conditions.

[Measurement Conditions]

Measurement jig: parallel plates each having a diameter of 7.9 mm

Measurement sample: cylindrical sample having a diameter of about 8 mm and a height of 3 mm prepared by heating, melting and molding each toner.

Measurement frequency: 1 Hz

Measurement temperature: 40° C. to 210° C.

Measurement strain: 0.1% as an initial value and the measurement was performed by an automatic measurement mode Correction of the elongation of the sample: the elongation of the sample was corrected by an automatic measurement mode —Evaluation of Cold Offset and Hot Offset—

Each toner was incorporated into a modified apparatus of IMAGIO NEO450 (product of Ricoh Company, Ltd.) containing the above-described fixing unit. This modified apparatus was adjusted so that solid images were formed on transfer paper sheets of plain paper and thick paper (type 6200 (product of Ricoh Company, Ltd.) and copy paper sheet <135> (product of Ricoh Business Expert, Ltd.) where each of the solid image carried the toner at 1.0 mg/cm$^2$±0.1 mg/cm$^2$. In addition, the modified apparatus was also adjusted so that the temperature of its fixing roller could be variable. The plain paper was used to measure a temperature at which no hot offset occurred, and the thick paper was used to measure a temperature at which no cold offset occurred. The minimum fixing temperature was defined as a temperature of the fixing belt at which the following phenomenon was confirmed. Specifically, when the fixed image was rubbed with a pat, the residual rate of the image density was 70% or higher.

—Difference in Glossiness—

In the evaluation of cold offset and hot offset, the fixed image when the temperature of the fixing belt was 170° C. was measured for glossiness with a gloss meter. The glossiness was evaluated according to the following criteria.

A: The difference between the maximum glossiness and the minimum glossiness was 0% or more but less than 3%.

B: The difference between the maximum glossiness and the minimum glossiness was 3% or more but less than 10%.

C: The difference between the maximum glossiness and the minimum glossiness was 10% or more.

TABLE 1

| Exs. Comp. Exs. | Toner | G'(100) | G'(110) | G'(150) | Gradient a | Qualities (evaluation) Cold offset | Hot offset | Difference in glossiness |
|---|---|---|---|---|---|---|---|---|
| Ex. 1 | Toner 1 | 19,640 | 12,570 | 3,367 | 0.019 | Not occurred | Not occurred | B |
| Ex. 2 | Toner 2 | 10,900 | 4,980 | 540 | 0.034 | Not occurred | Not occurred | B |
| Ex. 3 | Toner 3 | 16,500 | 8,010 | 1,200 | 0.031 | Not occurred | Not occurred | B |
| Ex. 4 | Toner 4 | 14,900 | 7,600 | 1,600 | 0.029 | Not occurred | Not occurred | B |
| Ex. 5 | Toner 5 | 12,800 | 7,400 | 3,200 | 0.024 | Not occurred | Not occurred | B |
| Ex. 6 | Toner 6 | 11,800 | 7,800 | 1,700 | 0.018 | Not occurred | Not occurred | A |
| Ex. 7 | Toner 7 | 6,200 | 4,800 | 1,700 | 0.011 | Not occurred | Not occurred | A |
| Comp. Ex. 1 | Toner 8 | 19,500 | 6,000 | 3,200 | 0.051 | Occurred | Not occurred | B |
| Comp. Ex. 2 | Toner 9 | 15,000 | 6,500 | 2,779 | 0.036 | Not occurred | Not occurred | C |
| Comp. Ex. 3 | Toner 10 | 11,700 | 3,480 | 434 | 0.053 | Not occurred | Occurred | C |
| Comp. Ex. 4 | Toner 11 | 37,740 | 24,180 | 3,541 | 0.019 | Occurred | Not occurred | A |
| Comp. Ex. 5 | Toner 12 | 20,500 | 11,360 | 2,450 | 0.026 | Occurred | Not occurred | B |

The above description is exemplary and the present invention provides specific effects in each of the following aspects.

(Aspect 1)

An image forming apparatus including:

an image bearing member;

a latent image forming unit configured to form a latent electrostatic image on the image bearing member;

a developing unit configured to develop the latent electrostatic image with a toner to form a toner image;

a transfer unit configured to transfer the toner image onto a recording medium;

a fixing unit configured to fix the transferred toner image on the recording medium, wherein the toner contains an amorphous polymer, a crystalline resin and a releasing agent, wherein when the toner is measured for storage modulus G' in a range of 40° C. to 210° C. with a rheometer at a measurement frequency of 1 Hz and a measurement strain of 1 deg, storage modulus G'(100) at 100° C. is 20,000 Pa or less and storage modulus G'(150) at 150° C. is 500 Pa or more, and a straight line drawn by connecting together a point of the storage modulus G'(100) and a point of storage modulus G'(110) at 110° C. on a curve of the storage modulus G' of the toner has a gradient of 0.035 or less where the gradient is "a" expressed by the following equation:

$$a=|\log_{10} G'(100)-\log_{10} G'(110)|/10, \text{ and} \quad \text{(Equation)}$$

wherein the fixing unit includes: a heating member containing a flexible endless belt; a heat source fixed within the flexible endless belt; and a press member in contact with the flexible endless belt to form a nip portion, and the fixing unit is configured to heat and press the recording medium passing through the nip portion to fix the image on the recording medium.

According to (Aspect 1), as described above, specifying a toner containing a crystalline polyester resin in terms of storage moduli G' at 100° C. and 150° C. and the gradient "a," expressed by the above equation, of a straight line drawn by connecting together a point of the storage modulus at 100° C. and a point of storage modulus at 110° C. makes it possible to obtain a toner having excellent offset resistance and glossiness at low fixing temperatures. Using a rheometer at a measurement frequency of 1 Hz and a measurement strain of 1 deg, the storage modulus G' is measured in a range of 40° C. to 210° C. at which the toner is heated. Then, storage moduli G' at low fixing temperatures; i.e., storage modulus G'(100) at 100° C., storage modulus G'(110) at 110° C. and storage modulus G'(150) at 150° C. are measured. The presence or absence of cold offset and hot offset and glossiness are measured at each temperature. As presented in the above experiments and evaluations, when the storage modulus G'(100) at 100° C. is 20,000 Pa or more, or the gradient "a" expressed by the above equation is more than 0.035, cold offset occurred. When the storage modulus G'(150) at 150° C. is less than 500 Pa and the gradient "a" expressed by the above equation is more than 0.035, hot offset occurred. When the storage modulus G'(100) at 100° C. is 20,000 Pa or more and the storage modulus G'(150) at 150° C. is 500 Pa or more but the gradient "a" expressed by the above equation is more than 0.035, glossiness was poor. These results indicate that good hot offset resistance, good cold offset resistance and good glossiness at low fixing temperatures can all be achieved when the storage modulus G'(100) at 100° C. is 20,000 Pa or less, the storage modulus G'(150) at 150° C. is 500 Pa or more, and the gradient "a" expressed by the above equation is 0.035 or less. The toner having the above properties can rapidly be increased in temperature upon heating to shorten the warm-up time. Also, even when an amount of heat supplied from the heat source is insufficient during printing and there are a drop in temperature and unevenness in temperature, the toner can provide stable fixing property by virtue of its low viscoelasticity and low dependency of its viscoelasticity on temperature. When the toner is used in a high-speed apparatus whose conveyance speed is high, the endless belt and the transfer paper (i.e., recording medium) attached to each other via the adhesion force of the toner are easily separable since the dependency of its viscoelasticity on temperature is small even at high-temperature portions. Thus, it is possible to provide an image forming apparatus where the transfer paper can be readily separated by the action of a slight force applied when the transit direction of the endless belt and the transit direction of the transfer paper are bifurcated at the exit of the nip portion.

(Aspect 2)

In (Aspect 1), in the fixing unit a portion of the press member which portion forms the nip portion or a portion of the press member which portion is upstream of the nip portion in a direction in which the recording medium moves is locally heated by the heat source.

As described above, with this configuration, the heat capacity can be reduced, so that the other members are not heated to increase the heat conversion efficiency.

(Aspect 3)

In (Aspect 1) or (Aspect 2), in the fixing unit a portion of the press member which portion forms the nip portion or a portion of the press member which portion is upstream of the nip portion in a direction in which the recording medium moves is made thinner than other portions.

As described above, with this configuration, the heat capacity can be reduced, so that the other members are not heated to increase the heat conversion efficiency, and it is possible to rapidly compensate the heat consumed at the nip portion when the recording medium passes therethrough, leading to improvement in fixing property.

(Aspect 4)

In any one of (Aspect 1) to (Aspect 3), the storage modulus G'(100) at 100° C. is 17,000 Pa or less, the storage modulus G'(150) at 150° C. is 1,000 Pa or more, and the gradient "a" is 0.032 or less.

As described above, with this configuration, the heat capacity can be reduced further.

(Aspect 5)

In any one of (Aspect 1) to (Aspect 4), the storage modulus G'(100) at 100° C. is 15,000 Pa or less, the storage modulus G'(150) at 150° C. is 1,500 Pa or more, and the gradient "a" is 0.030 or less.

As described above, with this configuration, the heat capacity can be reduced further.

(Aspect 6)

In any one of (Aspect 1) to (Aspect 5), the storage modulus G'(100) at 100° C. is 13,000 Pa or less, the storage modulus G'(150) at 150° C. is 1,500 Pa or more, and the gradient "a" is 0.025 or less.

As described above, with this configuration, the heat capacity can be reduced further and also the low-temperature fixing property can be improved further.

(Aspect 7)

In any one of (Aspect 1) to (Aspect 6), the storage modulus G'(100) at 100° C. is 12,000 Pa or less, the storage modulus G'(150) at 150° C. is 1,500 Pa or more, and the gradient "a" is 0.020 or less.

As described above, with this configuration, the heat capacity can be reduced further and also the low-temperature fixing property can be improved further. In addition, since the viscoelasticity changes to a lesser extent depending on the temperature, unevenness in glossiness can be prevented even when the fixing temperature is varied from place to place.

This application claims priority to Japanese application No. 2012-016620, filed on Jan. 30, 2012, and incorporated herein by reference.

What is claimed is:

1. An image forming apparatus comprising:

a toner;

an image bearing member;

a latent image forming unit configured to form a latent electrostatic image on the image bearing member;

a developing unit configured to develop the latent electrostatic image with a toner to form a toner image;

a transfer unit configured to transfer the toner image onto a recording medium;

a fixing unit configured to fix the transferred toner image on the recording medium, wherein the fixing unit comprises a heating member containing a flexible endless belt; a heat source fixed within the flexible endless belt; and a press member in contact with the flexible endless belt to form a nip portion, and the fixing unit is configured to heat and press the recording medium passing through the nip portion to fix the image on the recording medium;

wherein the toner contains an amorphous polymer, a crystalline resin and a releasing agent, wherein when the toner is measured for storage modulus G' in a range of 40° C. to 210° C. with a rheometer at a measurement frequency of 1 Hz and a measurement strain of 1 deg, storage modulus G'(100) at 100° C. is 20,000 Pa or less and storage modulus G'(150) at 150° C. is 500 Pa or more, and a straight line drawn by connecting together a point of the storage modulus G'(100) and a point of storage modulus G'(110) at 110° C. on a curve of the storage modulus G' of the toner has a gradient of 0.035 or less where the gradient is "a" expressed by the following equation:

$$a=|\log_{10} G'(100)-\log_{10} G'(110)|/10. \quad \text{(Equation)}$$

2. The image forming apparatus according to claim 1, wherein in the fixing unit, a portion of the press member which portion forms the nip portion or a portion of the press member which portion is upstream of the nip portion in a direction in which the recording medium moves is locally heated by the heat source.

3. The image forming apparatus according to claim 1, wherein in the fixing unit, a portion of the press member which portion forms the nip portion or a portion of the press member which portion is upstream of the nip portion in a direction in which the recording medium moves is made thinner than other portions.

4. The image forming apparatus according to claim 1, wherein the storage modulus G'(100) at 100° C. is 17,000 Pa or less, the storage modulus G'(150) at 150° C. is 1,000 Pa or more, and the gradient "a" is 0.032 or less.

5. The image forming apparatus according to claim 1, wherein the storage modulus G'(100) at 100° C. is 15,000 Pa or less, the storage modulus G'(150) at 150° C. is 1,500 Pa or more, and the gradient "a" is 0.030 or less.

6. The image forming apparatus according to claim 1, wherein the storage modulus G'(100) at 100° C. is 13,000 Pa or less, the storage modulus G'(150) at 150° C. is 1,500 Pa or more, and the gradient "a" is 0.025 or less.

7. The image forming apparatus according to claim 1, wherein the storage modulus G'(100) at 100° C. is 12,000 Pa or less, the storage modulus G'(150) at 150° C. is 1,500 Pa or more, and the gradient "a" is 0.020 or less.

8. The image forming apparatus of claim 1, wherein the image bearing member comprises an inorganic photoconductor made of amorphous silicon or selenium; or an organic photoconductor made of polysilane or phthalopolymethine.

9. The image forming apparatus of claim 1, wherein the image bearing member comprises an amorphous photoconductor having a support and a photoconductive layer of a-Si, which is formed on the support heated to 50° C. to 400° C. with a film forming method such as vacuum vapor deposition, sputtering, ion plating, thermal CVD (chemical vapor deposition), photo-CVD or plasma CVD.

10. The image forming apparatus of claim 1, wherein the image bearing member is cylindrical and has an outer diameter ranging from 3 mm to 100 mm.

11. The image forming apparatus of claim 1, wherein the latent image forming unit comprises a charging member configured to charge a surface of the image bearing member; and a light-exposing member configured to imagewise expose the surface of the image bearing member to light.

12. The image forming apparatus of claim 1 that comprises a charging member which is an electroconductive or semi-electroconductive roller, brush, film and rubber blade or other contact-type charging member; or a non-contact-type charging member that utilizes corona discharge or other non-contact-type charging member.

13. The image forming apparatus of claim 1, wherein the transfer unit comprises at least one corona discharge transfer device, transfer belt, transfer roller, press-transfer roller or adhesive transfer device.

14. The image forming apparatus of claim 1, wherein the developer unit comprises a stirrer configured to charge the toner by friction resulting from stirring, or comprises a rotatable magnet roller.

15. An image forming apparatus comprising:

means for bearing an image;

means for forming a latent electrostatic image on the means for bearing an image;

means for developing the latent electrostatic image with a toner to form a toner image;

means for transferring the toner image onto a recording medium;

a fixing unit for fixing the transferred toner image on the recording medium that comprises a heating member containing a flexible endless belt; a heat source fixed within the flexible endless belt; and a press member in contact with the flexible endless belt to form a nip portion, and the fixing unit is configured to heat and press the recording medium passing through the nip portion to fix the image on the recording medium;

wherein the toner contains an amorphous polymer, a crystalline resin and a releasing agent, and wherein when the toner is measured for storage modulus G' in a range of 40° C. to 210° C. with a rheometer at a measurement frequency of 1 Hz and a measurement strain of 1 deg, storage modulus G'(100) at 100° C. is 20,000 Pa or less and storage modulus G'(150) at 150° C. is 500 Pa or more, and a straight line drawn by connecting together a point of the storage modulus G'(100) and a point of storage modulus G'(110) at 110° C. on a curve of the storage modulus G' of the toner has a gradient of 0.035 or less where the gradient is "a" expressed by the following equation:

$$a=|\log_{10} G'(100)-\log_{10} G'(110)|/10. \quad \text{(Equation)}$$

* * * * *